US007827829B2

(12) United States Patent
Fujikawa

(10) Patent No.: US 7,827,829 B2
(45) Date of Patent: Nov. 9, 2010

(54) ELASTIC FABRIC AND ELASTIC FACE MATERIAL

(75) Inventor: Tomoki Fujikawa, Shiga (JP)

(73) Assignee: Kawashimaorimono Co., Ltd., Kyoto (JP)

( * ) Notice: Subject to any disclaimer, the term of this patent is extended or adjusted under 35 U.S.C. 154(b) by 1318 days.

(21) Appl. No.: 10/523,712

(22) PCT Filed: Aug. 4, 2003

(86) PCT No.: PCT/JP03/09847

§ 371 (c)(1),
(2), (4) Date: Oct. 24, 2005

(87) PCT Pub. No.: WO2004/015181

PCT Pub. Date: Feb. 19, 2004

(65) Prior Publication Data

US 2006/0207296 A1 Sep. 21, 2006

(30) Foreign Application Priority Data

| | | |
|---|---|---|
| Aug. 7, 2002 | (JP) | 2002-230525 |
| Aug. 7, 2002 | (JP) | 2002-230526 |
| Oct. 4, 2002 | (JP) | 2002-293013 |
| Oct. 4, 2002 | (JP) | 2002-293014 |
| Dec. 27, 2002 | (JP) | 2002-381385 |

(51) Int. Cl.
*D04B 21/00* (2006.01)

(52) U.S. Cl. ..... 66/195

(58) Field of Classification Search ..... 66/190, 66/192, 193, 195
See application file for complete search history.

(56) References Cited

U.S. PATENT DOCUMENTS

| | | | | |
|---|---|---|---|---|
| 3,981,415 | A * | 9/1976 | Fowler et al. | 66/193 |
| 4,052,866 | A * | 10/1977 | Saunders | 66/193 |
| 4,173,131 | A * | 11/1979 | Pendergrass et al. | 66/193 |
| 4,340,091 | A * | 7/1982 | Skelton et al. | 139/383 R |
| 4,733,545 | A * | 3/1988 | Weinle et al. | 66/202 |
| 5,133,199 | A * | 7/1992 | Parikh et al. | 66/192 |
| 5,415,007 | A * | 5/1995 | Eng | 66/192 |
| 6,389,851 | B1 * | 5/2002 | Groshens | 66/192 |
| 7,201,024 | B2 * | 4/2007 | Hirayama et al. | 66/192 |

FOREIGN PATENT DOCUMENTS

| | | |
|---|---|---|
| JP | 6-57579 | 3/1994 |
| JP | 09-157994 | 6/1997 |
| JP | 2000-248450 | 9/2000 |
| JP | 2001-159052 | 6/2001 |
| JP | 2001-303395 | 10/2001 |
| JP | 2003-155648 | 5/2003 |

* cited by examiner

*Primary Examiner*—Danny Worrell
(74) *Attorney, Agent, or Firm*—Fox Rothschild LLP

(57) ABSTRACT

An elastic fabric useable for covering pillows, seats, mattresses and the like is disclosed. The fabric is formed from elastic yarns having a breaking elongation greater than 60%, a rate of elastic recovery after 15% elongation of more than 90% and a stress at 10% elongation greater than 150 N/5 cm and less than 600 N/5 cm oriented in a direction parallel to the elastic yarn, and a rate of hysteresis loss between 20% and 45%. The fabric may be woven or knitted and provides a stable, comfortable feeling for sitting or reclining and deforms when supporting weight but returns readily to its undeformed shape.

29 Claims, 10 Drawing Sheets

ELASTIC FABRIC AND ELASTIC FACE MATERIAL

FIELD OF THE INVENTION

The present invention relates to an elastic cover material which is used as a cover for pillows, cushions, benches, backrests, armrests, chairs, seats, beds, mattresses and the like.

BACKGROUND OF THE INVENTION

Conventional elastic cover materials according to the prior art include fabric, leather and the like, and are used to cover porous constructions such as urethane foam or other resin foams, stratified formations which are formed by stratifying polyester fiber or other fibers, as well as spring constructions formed from flat springs, coil springs or other springs.

A conventional elastic cover material effects an agreeable soft feeling, when one's limbs are weighted thereon due to balancing of pressed strain, which may be raised in its thickness direction, and elastic recovery force which may be raised in accordance with the pressed strain. However, in the case where the pressed strain rises relatively too little in comparison with elastic recovery force, hard and painful feeling may be effected. On the other hand, in the case where the pressed strain rises relatively too much in comparison with the elastic recovery force, fatigue may ensue since the limbs are supported in an unstable manner. In order for the conventional elastic cover material to effect an agreeable soft feeling due to the balancing of pressed strain and elastic recovery force, the conventional elastic cover material has to be thick. Thus, conventional elastic cover material, being thick and bulky occupies good deal of space and is difficult to transport in bulk. There is clearly a need to improve the conventional elastic cover material in this respect.

Therefore, the present invention is intended to provide an improved elastic cover material on which limbs are supported stably, and which is thin, lightweight and less bulky as a whole, and which is easy to handle.

SUMMARY OF THE INVENTION

An elastic fabric of the present invention is characterized by the following features:

(i) an elastic yarn is applied to warp yarns or weft yarns;

(ii) breaking elongation of the elastic yarn is more than 60%, and rate of elastic recovery after 15% elongation of the elastic yarn is more than 90%;

(iii) the elastic fabric has a stress at 10% elongation of more than 150 N/5 cm and less than 600 N/5 cm in the direction (X) lengthwise along the elastic yarn;

(iv) the rate of hysteresis loss Δ E which is calculated by the equation $$\Delta E=100\times C/V=100\times(V-W)/V \text{ is } 20\sim45\% \quad (20\leqq\Delta E\leqq45);$$

Wherein:

(i) V is an integral value which is calculated by integrating the load-elongation equation ($f_0(\rho)$) from 0% to 10% elongation in the direction (X) lengthwise along the elastic yarn, where the load-elongation equation ($f_0(\rho)$) is defined by the loading curve ($f_0$) of the hysteresis in a load-elongation diagram;

(ii) W is an integral value which is calculated by integrating the load-elongation equation ($f_0(\rho)$) from 10% to 0% elongation in the direction (X) lengthwise along the elastic yarn, where the load-elongation equation ($f_0(\rho)$) is defined by the load-reducing curve ($f_1$) of the hysteresis in a load-elongation diagram; and (iii) C=V−W is the value of hysteresis loss which is calculated as the difference between the integral values V and W.

DETAILED DESCRIPTION OF PREFERRED EMBODIMENTS

A preferred embodiment of an elastic fabric according to the present invention has a bulk density (J=T×G; dtex/cm) more than 17000 dtex/cm. The bulk density (J=T×G) is defined as the product of average fineness of an elastic yarn (T; dtex/number) and the number of elastic yarns per unit length (G=M/L; number/cm) which is calculated by dividing the number of elastic yarns (M; number) by the length L (L; cm) in the direction (Y) orthogonal to the elastic yarns (11) (direction X).

Another embodiment of the present invention is an elastic fabric having a covering rate (K) more than 30% (K=100×M×D/1≧30%). The covering rate (K) is defined as 100 times the product (M×D) divided by the length l, wherein M is the number of elastic yarns per unit length in the X direction, D is the average diameter of the elastic yarns (D; cm), which is defined by the square root of the product (S×k) where (k=4×π−1) and S is the areas (S; $cm^2$) of the cross section of the elastic yarns which are disposed at regular intervals (L; cm) in the direction (Y) which is orthogonal to direction (X) the, lengthwise direction of elastic yarns (11), and 1 is the length in the Y direction.

Figure 4:
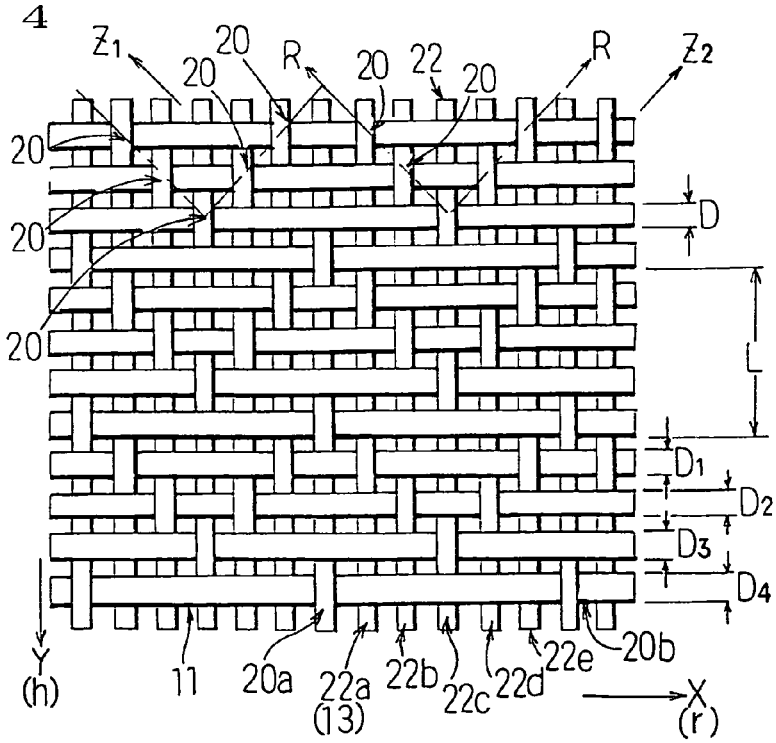

In the case of a woven elastic fabric (10) (FIGS. 4 and 8), elastic yarns may be applied to either warp yarns or weft yarns, inelastic yarns may be used for intersecting yarns (22) which are orthogonal to the elastic yarns (11). It is preferable to apply the woven elastic fabric to woven textile designs, where the continuity direction (R) of intersections (20) form zigzag lines or radial lines, such as pointed twill weaves, entwining twill weaves, herring-bone twill weaves, skip draft twill weaves, and modified twill weaves, or a woven textile design, for which the rate of intersection (H=P/m) is less than 0.5, such as mat weaves, matt weaves, basket weaves, hopsack weaves, warp-weft weaves, irregular or fancy mat weaves, stitched mat weaves and other modified plain weaves (FIG. 4).

Figure 5:
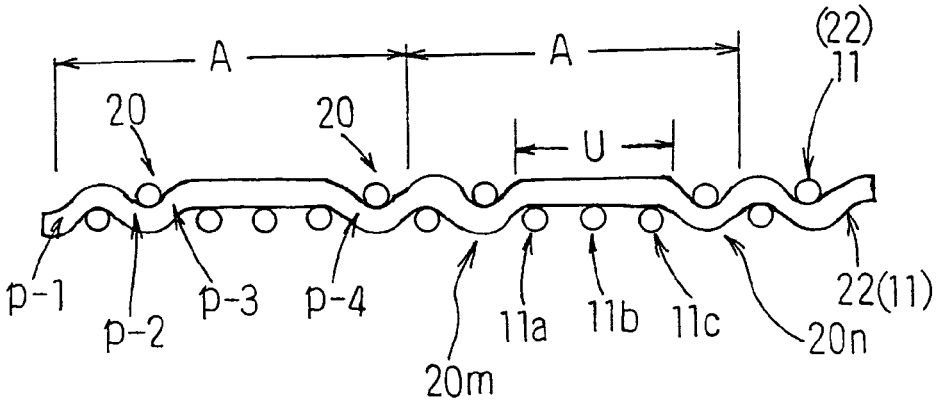
FIG. 5 is a sectional view of an elastic fabric in accordance with the present invention.

It is desirable to design the woven elastic fabric (10) in a manner where the rate of intersection (H=P/m), which is defined by dividing the number (P) of bending points (p-1,p-2,p-3,p-4) in front and/or in rear of intersections (20) in complete textile design of the woven elastic fabric (10) where the elastic yarn (11) and the intersecting yarn (22) bend and change their dispositions one another from surface side to back side or from back side to surface side, by the number (m)

of the intersecting yarns (22), which consist complete textile design, is less than 0.5 ($H=P/m \leqq 0.5$) (FIG. 5). It is also desirable to design the woven elastic fabric (10) in a manner where product value ($H \times K$) of rate of intersection (H) and covering rate (K) of the elastic yarn (11) is more than 0.1 ($H \times K \geqq 0.1$).

It is further desirable to design the woven elastic fabric (10) in a manner where the bulk density (J; dtex/cm) of the elastic yarn (11) is from 0.5 to 3.0 times the bulk density (j; dtex/cm) of the intersecting yarn (22) which is an inelastic yarn and is orthogonal to the elastic yarn (11) ($0.5 \times j \leqq J \leqq 3.0 \times j$). The bulk (J; dtex/cm) of the elastic yarn is calculated as the product of average fineness (T; dtex) and density of the arrangement ($G=n/L$; number/cm) of the elastic yarn (11) which is calculated by dividing number of elastic yarns (n; number) by the length (L; cm) in the direction (Y) orthogonal to the direction in which the elastic yarns (11) extend. In the same way, the bulk (j; dtex/cm) of the intersecting yarn (22), which is an inelastic yarn, is calculated as the product of average fineness (t; dtex) and density of the arrangement ($g=m/L$; number/cm) of the intersecting yarn (22) which is calculated by dividing the number of intersecting yarns (m; number) by the length (L; cm) in the direction (X) where the elastic yarns (11) extend.

An elastic top material (62) (see FIG. 7) is formed by stretching and hanging the elastic fabric (10), which is applied for supporting limbs, between both frame parts (61*a*, 61*b*) which are positioned at both sides of a frame (60) in a manner where both frame parts (61*a*, 61*b*) are opposite to one another. The cushioning surface (63) of the elastic top material is formed from the elastic fabric (10) for supporting limbs. The elastic fabric (10) is stretched over the frame (60) by setting the lengthwise direction (X) of the elastic yarn (11) orthogonal to both frame parts (61*a*, 61*b*), that is, by setting the lengthwise direction (X) in the width direction of the elastic top material (62).

The elastic fabric is designed by incorporating the elastic yarn (11) into the elastic fabric in a manner where the elastic yarns are located in line either lengthwise or crosswise, so that the elastic fabric has;

(i) a stress at 10% elongation (F) more than 150 N/5 cm and less than 600 N/5 cm ($150 \leqq F \leqq 600$; N/5 cm) in the lengthwise direction (X) where the incorporated elastic yarns are continuous without cut inside of the elastic fabric, (ii) a stress at 10% elongation (B) in the 45 degree bias direction (Z), where the bias direction has an inclination of 45 degrees to the lengthwise direction (X), more than 5% and less than 20% in comparison with stress at 10% elongation (F) in the lengthwise direction (X), and (iii) a rate of hysteresis loss ($\Delta E$) at 10% elongation in the prolonging direction (X) within 20~45% ($20 \leqq \Delta E \leqq 45$).

The elastic top material (62) is formed by stretching over and by fixing both edges of the elastic fabric (10) to the frame parts (61*a*, 61*b*) which are positioned at both sides of frame (60) and are opposite one another. In the elastic top material (62), the elastic fabric is deflected into an arched shape in the lengthwise direction (X) of the elastic yarn (11) when limbs are put on there. Simultaneously, the elastic fabric is also deflected into an arched shape in the orthogonal direction (Y) at right angles to the lengthwise direction (X) of the elastic yarn (11) and is transformed into a moderate shape, the weight of limbs is dispersed in all directions of the elastic fabric. The elastic fabric does not effect a hard feeling but recovers its original form as soon as the weight of the limbs is removed. And, a load mark does not remain where the limbs have been put on for a long time.

In the case where stress at 10% elongation (F) of the elastic fabric is designed less than 150 N/5 cm, sagging of the elastic fabric due to the weight of limbs increases and the periphery of the sagged portion of the elastic fabric effects a cramped feeling. And, the capacity of the elastic fabric to recover its original form after the weight of limbs is removed diminished. And, a load mark, which may be effected by the weight of limbs, tends to remain over the elastic fabric and results from load-hysteresis fatigue due to the delay in recovering of the original form. On the other hand, in the case where stress at 10% elongation (F) of the elastic fabric is more than 600 N/5 cm, it becomes unbearable to put limbs on the elastic fabric for a long time, since the elastic fabric effects a hard feeling. In the present invention, a reason to design a rate of hysteresis loss ($\Delta E$) at 10% elongation within 20~45% ($20 \leqq \Delta E \leqq 45$) is that when it is designed less than 20%, an elastic peculiarity of the elastic fabric becomes similar to that of a steel spring and the elastic fabric tends to effect a hard feeling through its elasticity. On the other hand, in the case where the rate of hysteresis loss ($\Delta E$) at 10% elongation is designed more than 45%, the elastic fabric effects a deflected, sticky feeling when limbs are put on it, and it becomes hard for it to recover its original form, and load marks tends to remain over the elastic fabric after limbs are removed. Then, it becomes hard to obtain cushioning characteristics which are rich in soft feeling and load-hysteresis fatigue resistance. In consideration of these matters, the elastic fabric is designed so that stress at 10% elongation (F) is between 200~400 N/5 cm and the rate of hysteresis loss ($\Delta E$) at 10% elongation is about 25%.

The rate of hysteresis loss $\Delta E$ is calculated by dividing the hysteresis loss (C) by the value (V) wherein the hysteresis loss (C) is calculated as the difference between values (V) and (W). The value (V) is calculated by integrating the load-elongation equation $f_0(\rho)$ from 0% to 10% elongation in the direction (X) where the elastic yarn is continuous without cut in the elastic fabric, and where the load-elongation equation $f_0(\rho)$ is defined by the loading curve ($f_0$) of the hysteresis in the load-elongation diagram. The integral value (W) is calculated by integrating the load-elongation equation $f_0(\rho)$ from 10% to 0% elongation in the direction (X) where the elastic yarn is continuous without cut in the elastic fabric, and where the load-elongation equation $f_0(\rho)$ is defined by the load-reducing curve ($f_1$) of the hysteresis in the load-elongation diagram. Detailed calculation of the rate of hysteresis loss ($\Delta E$) at 10% elongation is explained as follows.

(i) A test piece 50 mm in width and 250 mm in length is cut from the elastic fabric and is positioned between grips spaced 150 mm apart in a load-elongation testing machine where the loading-elongating velocity is adjusted to 150 mm/min. and an initial load is adjusted to 4.9 N.

(ii) The test piece is pre-elongated 10% by loading.

(iii) The test piece is conditioned by decreasing the load to the initial load.

(iv) After this conditioning, the test piece is elongated 10% and the loading curve ($f_0$) of the hysteresis is drawn in Cartesian coordinates with the elongation axis ($X_\rho$) and the load axis (YF).

Figure 6:
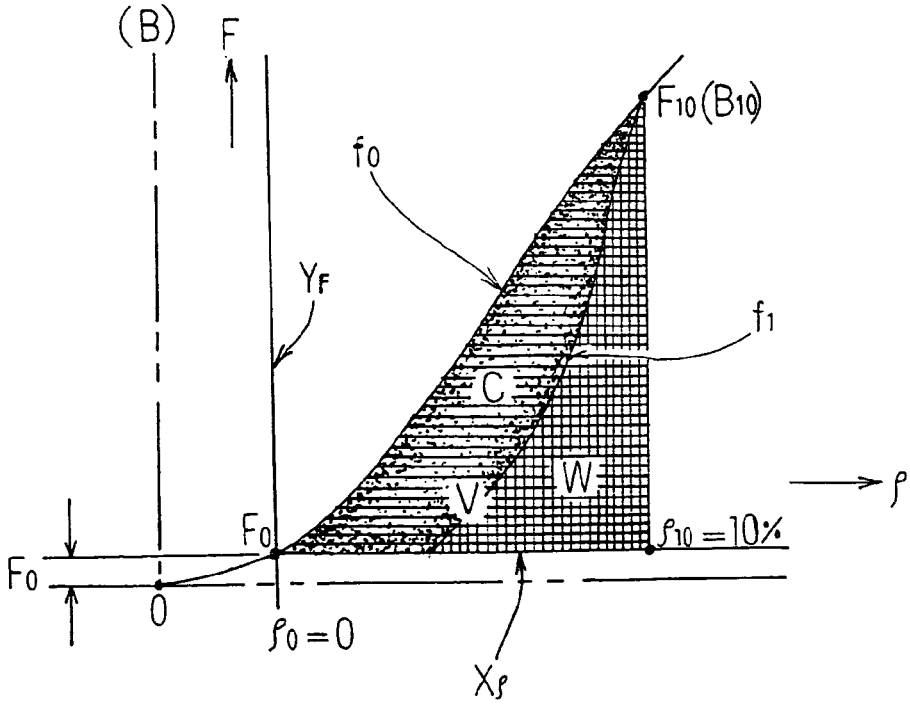
FIG. 6 is a load-elongation diagram of an elastic fabric in accordance with the present invention.

Subsequently, load decreases until the initial load ($F_0$) is reached and the load-reducing curve ($f_1$) is drawn (FIG. 6). In the Cartesian coordinates, the loading hysteresis area (V), which is bounded by the loading curve ($f_0$), the line ($F_{10}$-$\rho_{10}$) which passes through the 10% elongation loading point ($F_{10}$) and crosses at right angles to the elongation axis ($X_\rho$), and the elongation axis ($X_\rho$), is measured. Also, the reducing hysteresis area (W) which is bounded by the load-reducing curve ($f_1$), the line ($F_{10}$-$\rho_{10}$) which passes through the 10% elongation loading point ($F_{10}$) and crosses at right angles to the elongation axis ($X_\rho$), and the elongation axis ($X_\rho$), is measured. The hysteresis loss (C) is calculated as the difference (V−W) between the loading hysteresis area (V) and the reducing hysteresis area (W). Then, the rate of hysteresis loss (ΔE) is calculated by dividing the hysteresis loss (C) by the loading hysteresis area (V).

A reason to design fabric having stress at 10% elongation (B) in the 45 degree bias direction (Z), which has an inclination of 45 degrees to the lengthwise direction (X), to more than 5% and less than 20% in comparison with the stress at 10% elongation (F) in the lengthwise direction (X) is explained as follows. In the case where stress at 10% elongation (B) in the 45 degrees bias direction (Z) becomes less than 5% of the stress at 10% elongation (F) in the lengthwise direction (X), where the elastic yarn is continuous, the elastic fabric loses its capacity to recover its original form after the limbs are removed, and knitted textile designs or woven textile designs of the elastic fabric become transformable, that is, a distortion of so-called textile opening tends to occur due to slipping of yarns (11, 22). On the other hand, in the case where stress at 10% elongation (B) in the 45 degree bias direction (Z) becomes more than 20% of the stress at 10% elongation (F) in the lengthwise direction (X), the elastic fabric tends to effect a hard feeling, since the distortion of knitted or woven textile designs of the elastic fabric is less, the weight of limbs loaded on the elastic fabric is not dispersed in all directions, and sagged recesses are hardly formed according to the shape of limbs at the portion where limbs are placed on the fabric, then limbs are not supported in a stable manner.

A reason to design the bulk density (J=T×G; dtex/cm) of the elastic yarn (11), which is defined as the product of the average fineness of an elastic yarn (T; dtex/number) and the density of the arrangement of the elastic yarn (G=M/L; number/cm), more than 17000 dtex/cm, is explained as follows. In the elastic fabric, when the elastic yarns are parallel and neighboring so closely as to touch one another, and when each of them does not stretch independently, and when tensile stress acts on every one of them, the tensile stress is distributed and acts on other neighboring yarns. In such a way, weight of the limbs is distributed from one yarn to another, so that only a few elastic yarns (11) do not slip at the extreme limits of the elastic fabric. Then, the elastic fabric is designed so that some distortion of the knitted or woven textile design is distributed over a lot of elastic yarns so that the elastic fabric returns to its original form after the limbs (or load or weight) are removed. Accordingly, the elastic fabric becomes rich in load-hysteresis fatigue resistance and load marks hardly remain in the portion of the fabric where the limbs were supported for a long time. In consideration of these matters, the bulk density (J=T×G; dtex/cm) of the elastic yarn (11) should have a value of more than 17000 dtex/cm, thus stress at 10% elongation (F) in the lengthwise direction (X), where the elastic yarn (11) is continuous, should have a value of more than 150 N/5 cm and less than 600 N/5 cm, and stress at 10% elongation (B) in the 45 degree bias direction (Z) should have a value of more than 5% and less than 20%. As a result, it becomes easy to set up the rate of hysteresis loss (ΔE) at 10% elongation in the lengthwise direction (X) within 20~45%.

For the same reason, the covering rate (K) of the elastic yarn (11) should be more than 30%. When the covering rate (K) of the elastic yarn (11) is more than 30%, the elastic yarns, which are arranged densely, increase the elongation of the intersecting yarns (22), which are orthogonal to the elastic yarns (11). The elastic yarns act as a wedge which is inserted into the arrangement which is formed by the intersecting yarns (22). Therefore, the weight of limbs is easily distributed between every adjacent elastic yarn through the intersecting yarns (22). As a result, the elastic fabric becomes elastically conformable so as to fit the shape of limbs which are put thereon and also becomes soft and resilient.

The elastic yarn (11) is woven or knitted in the elastic fabric in a manner to be in continuous as a whole being intermittent partially in the width direction of the fabric or in a manner to be in continuous completely through the full width of the fabric, or in a manner to be in continuous as a whole being intermittent partially in the length direction of the fabric or in a manner to be in continuous completely through the full length of the fabric. It is desirable to set up the bulk density (J) of the elastic yarn to be more than 17000 dtex/cm by designing the average fineness (T) of the elastic yarn in thick and by designing the density (G) of the arrangement of the elastic yarn in loose so that the arranged situation of the elastic yarn is easily kept in line. It is also desirable to compose the elastic yarn as a type of monofilament yarn so that the arranged situation of the elastic yarn is easily kept in line. However, where the elastic yarn is composed of multiple fibers or yarns as a type of multifilament yarn, the number of the fibers or the number of single yarns of the elastic yarn should be set up less than 5 (threads). That is, the elastic yarn should be composed of several thick monofilament yarns in a shape as if these yarns were drawn in parallel. The elastic yarn may be composed together with elastic fibers and inelastic fibers in sheath core shape by twining and covering the elastic fibers with the inelastic fibers.

FIGS. 1-4 show examples of the textile design of the elastic fabrics. In the elastic fabric shown in FIG. 1, the inelastic yarns (the intersecting yarns (13)) form a base weft knitted fabric. The elastic yarns (11) are threaded in the base weft knitted fabric and pass under the space between the needle loops (40, 40) of every neighboring wales in each course and are continuous in line in the knitting width direction (Γ). In the elastic fabric shown in FIG. 2, the inelastic yarns (the intersecting yarns (13)) form the base warp knitted fabric. The elastic yarns (11) are threaded in the base weft knitted fabric and pass through the space between the needle loop (40) and the sinker loop (50) and are in continuous in line in the knitting width direction (Γ). In the elastic fabric shown in FIG. 3, the base warp knitted fabric is formed with the inelastic yarns (13*x*) which form the chain stitched rows in line in the knitting length direction and the inelastic inserted yarns (the intersecting yarns 22*a*) which are connecting the adjacent chain stitched rows. The elastic yarns (11) are threaded in the base warp knitted fabric and pass through the space between the adjacent chain stitched rows (39, 39) in a manner of passing over the inelastic inserted yarn (22*a*) and passing under the inelastic inserted yarn (22*a*) in each course and are in continuous in line in the knitting length direction (Σ).

Figure 1:
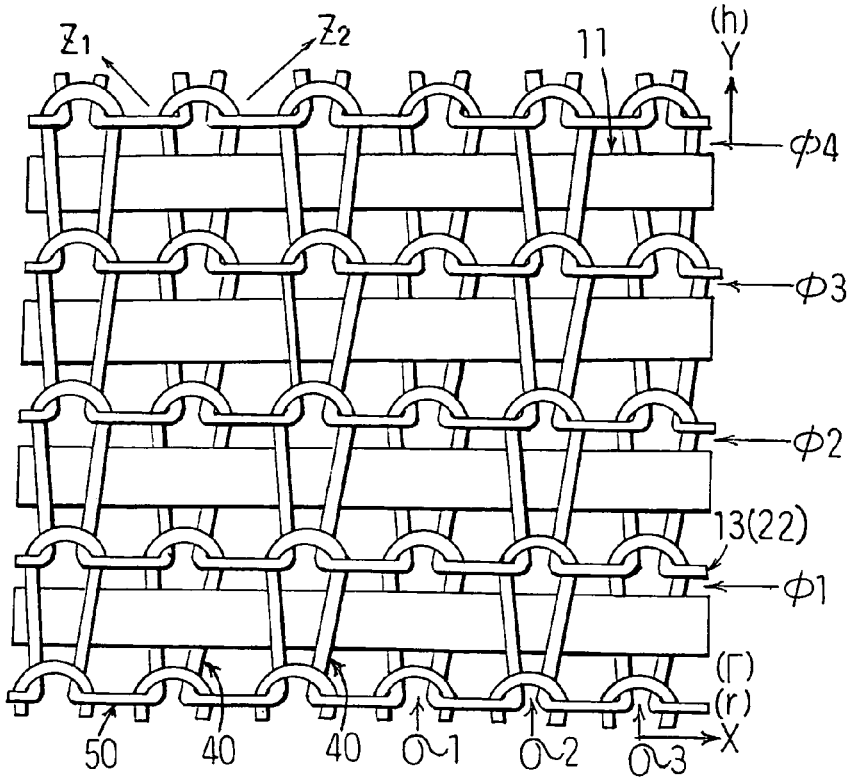
FIGS. 1-4 are plan views of elastic fabrics in accordance with the present invention.
Figure 2:
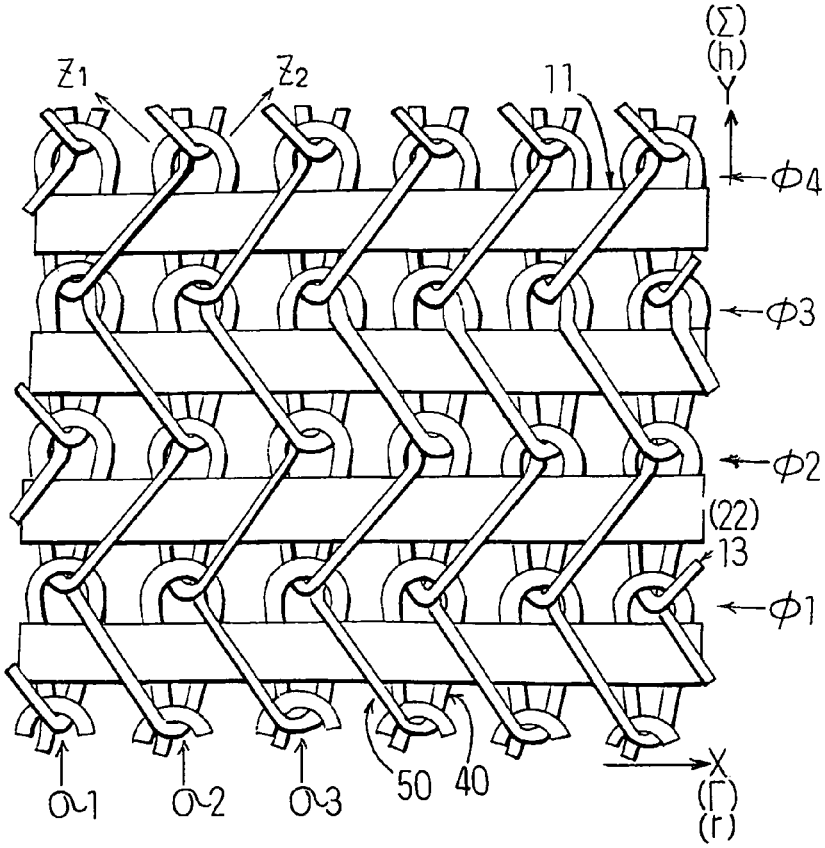
Figure 3:
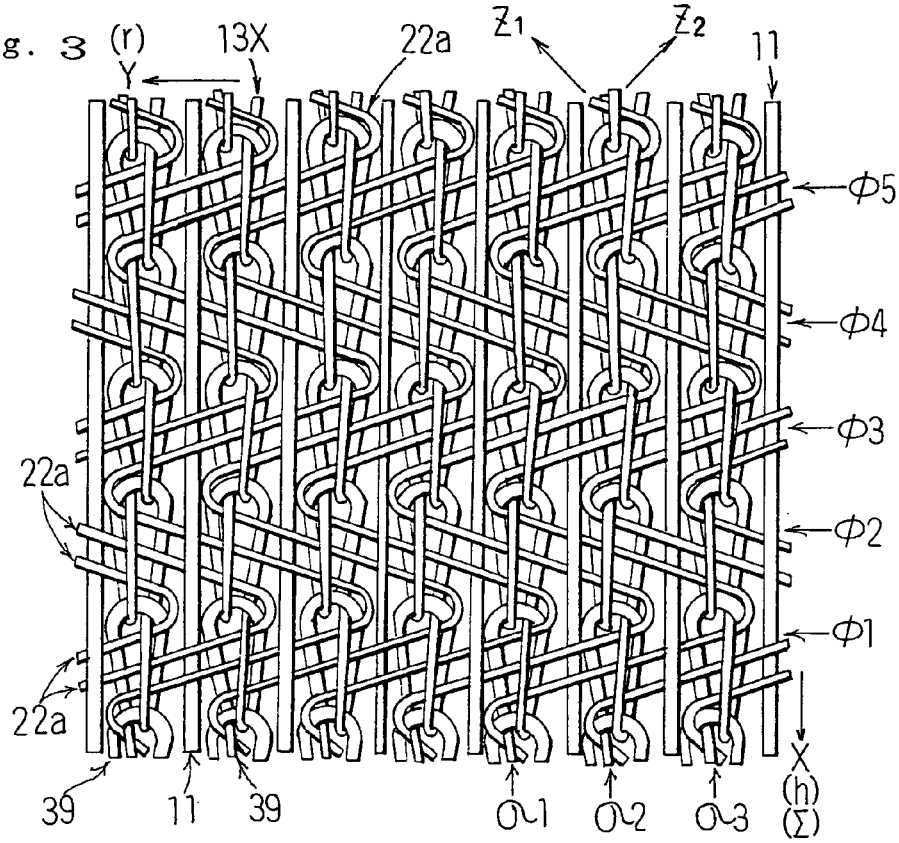

As shown in FIGS. 1-3, in the elastic knitted fabric, it is desirable to apply inelastic yarn to all of the intersecting yarns (22) which cross the elastic yarns (11) which are continuous. Also, as shown in FIGS. 1-3, in the elastic knitted fabric, the elastic yarn (11) may be arranged weftwise and warpwise. However, in the elastic woven fabric, in consideration of easiness in the weaving process, it is desirable to apply an elastic yarn (11) to the weft yarn, and to apply an inlastic yarn to the warp yarn (that is, the intersecting yarn 22). FIG. 4 shows the elastic woven fabric wherein the elastic yarn is applied to the weft yarn and the inlastic yarn is applied to the warp yarn.

The elastic knitted fabric is deformable lengthwise and crosswise, since the warp knitted fabric is formed with arched needle loops (40) and arched sinker loops (40) where the yarns are bent into arched shapes. Therefore, there is not a significant difference between the stress at 10% elongation ($B_1$) in the 45 degree leftwise bias direction ($Z_1$), which has a leftwise inclination of 45 degrees from the lengthwise direction (X), and the stress at 10% elongation ($B_2$) in the 45 degree rightwise bias direction ($Z_2$), which has a rightwise inclination of 45 degrees from the lengthwise direction (X). Thus, the weight of limbs, which is loaded on the elastic knitted fabric, is distributed in all directions. In this connection, however, in the elastic woven fabric, the difference between stress at 10% elongation ($B_1$) in the 45 degree leftwise bias direction ($Z_1$) and stress at 10% elongation ($B_2$) in the 45 degree rightwise bias direction ($Z_2$) becomes larger in accordance with the manner of the continuity of the intersection points (20) in the woven textile design. Therefore, the elastic woven fabric is lacking in load-hysteresis fatigue resistance in comparison with the elastic knitted fabric in accordance with the difference of stress at 10% elongation between the 45 degree leftwise bias direction ($Z_1$) and the 45 degree rightwise bias direction ($Z_2$). To decrease the difference of stress at 10% elongation, the satin weave, which lacks continuity in the disposition of the intersection points (20), may be applied to the elastic woven fabric. However, by the application of the satin weave, the elastic woven fabric, which is rich in load-hysteresis fatigue resistance, is not obtained, since the satin weave lacks fixity between the warp yarn and the weft yarn, so that stress is hardly distributed from one yarn to another between adjacent elastic yarns.

Thus, woven textile designs where the intersection points (20) are disposed in zigzag and/or radial manner in the continuity direction (R) such as pointed twill weaves, entwining twill weaves, herring-bone twill weaves, skip draft twill weaves and modified twill weaves, or woven textile designs for which the rate of the intersection (H=P/m) is less than 0.5, such as mat weaves, matt weaves, basket weaves, hopsack weaves, warp-weft weaves, irregular or fancy mat weaves, stitched mat weaves and other modified plain weaves, are applied to the elastic woven fabric. In the elastic woven fabric wherein such a weaving textile design is applied, the intersection points (20) continue in the 45 degree leftwise bias direction ($Z_1$) and in the 45 degree rightwise bias direction ($Z_2$) at the same rate. As a result, the fixity between the warp yarns and the weft yarns is maintained, and the manner of the continuity of the intersection points (20) in the 45 degree leftwise bias direction ($Z_1$) and in the 45 degree rightwise bias direction ($Z_2$) become even. Therefore, large differences in stress at 10% elongation (B) between those bias directions ($Z_1$, $Z_2$) does not occur, and load-hysteresis fatigue resistance of the elastic woven fabric increases.

Furthermore, for an increment of the load-hysteresis fatigue resistance of the elastic woven fabric, the covering rate (K) of the elastic yarn (11) should be more than 30% so as to make slippage between the elastic yarns minimal so that the elastic yarns (11*a*, 11*b*, 11*c*, etc.) stick fast to one another and are collected between the intersection points (20*m*, 20*n*) by potential inside shrinking stress of the intersecting yarns (22). This is effected as a reaction stress when the intersecting yarns (22) are elongated between the intersection points (20*m*, 20*n*). However, in the case where the covering rate (K) of the elastic yarn (11) is more than 30%, and when the fineness of the elastic yarn is thicker than regular fineness which should be limited in proportion to the weaving density, the elastic fabric which is rich in load-hysteresis fatigue resistance cannot be always obtained.

The reason for this is explained as follows. When the density of the warp yarns of the woven fabric is high, a plurality of warp yarns (22*a*, 22*b*, 22*c*), which comprise the complete textile design of the woven fabric, are constrained so as to maintain the width of the arrangement of the warp yarns between the intersections (20*a*, 20*b*) by the weft yarns (elastic yarns 11). On the other hand, the weft yarns (11) are stretched due to the reaction from the plurality of warp yarns (22*a*, 22*b*, 22*c*) which are arranged in high density between the intersections (20*a*, 20*b*) and which require a force to widen the width of the arrangement of the warp yarns. In the case of a plane and fine woven fabric for which the density of the warp is high, balance between the weft yarns (11) and the warp yarns (22*a*, 22*b*, 22*c*) is maintained, and a plane configuration of fabric is maintained. However, when the number of the warp yarns (22*a*, 22*b*, 22*c*) is more than the regular limitation, protuberances appear over the surface of the woven fabric. Since the weft yarns (11) are brought into extremely strained situation at the inside of the woven fabric, the potential inside shrinking stress, which acts to restore the regular length of the weft yarn (11) in proportion to the regular number of warp yarns (intersecting yarns 22*a*, 22*b*, 22*c*), arises at the inside of the woven fabric. Then, the weft yarns (11) are brought into the situation where they tend to shrink. On the other hand, the plurality of warp yarns (22*a*, 22*b*, 22*c*) also act to restore the regular width between the intersections (20*a*, 20*b*) in proportion to the regular number of warp yarns. As a result, the warp yarns (22) tend to swell out in the thickness direction of the woven fabric. As explained above, in the case where the density of the warp yarns of the woven fabric is denser than the regular density which should be suitably designed in proportion to the fineness of yarn, the regular plane surface of the woven fabric is not maintained. It is the same in the case where the density of the weft is designed denser than the regular density which should be suitably designed in proportion to the fineness of the weft yarn (11).

The reason to design the rate of the intersection (H) less than 0.5 is that the intersecting yarns (22) which cross the elastic yarns (11) are not so far elongated between the intersections (20*m*, 20*n*) that the undulatory puckers or crimps appear over the surface of the elastic fabric. Where the rate of the intersection (H) is more than 0.5, the frequency of the intersection points (20) formed together with the warp yarns (22) and the weft yarns (elastic yarns 11) is low, and the warp yarns (22) pass over a lot of weft yarns (elastic yarns 11) and float out of the surface of the elastic fabric. In the case where the length (U) of the floating portion of the warp yarn is long, elongation of the elastic yarns (11*a*, 11*b*, 11*c*) between the intersections (20*m*, 20*n*) may be diminished. However, in such a case, a plurality of elastic yarns (11*a*, 11*b*, 11*c*), which may be included between the intersections (20*m*, 20*n*), become free since the elastic yarns, (11*a*, 11*b*, 11*c*) are not tightly restricted by the intersecting yarns (22). Consequently, the weight of limbs loaded on the elastic fabric cannot be easily distributed from one elastic yarn to another.

Therefore, to increase the load-hysteresis fatigue resistance of the elastic woven fabric:

(i) the rate of intersection (H=P/m), which is defined by dividing the number of bending points (p-1,p-2,p-3,p-4) in the front and/or in the rear of the intersections (20) in the woven elastic fabric (10), where the elastic yarns (11) and the intersecting yarns (22) bend and change their dispositions from the surface side to the back side or from the back side to the surface side, by the number of the intersecting yarns (22) in the textile, is designed less than 0.5($H=P/m \leqq 0.5$), and (ii) the product ($H \times K$) of the rate of intersection (H) and the covering rate (K) of the elastic yarn (11) is designed to be more than 0.1 ($H \times K \geqq 0.1$).

Furthermore and preferably for increasing the load-hysteresis fatigue resistance of the elastic woven fabric:

(iii) the bulk density (J; dtex/cm) of the elastic yarn (11) is designed from 0.5 to 3.0 times the bulk density (j; dtex/cm) of the intersecting yarn (22) which is an inelastic yarn and crosses the elastic yarn (11) at right angles ($0.5\times j \leqq J \leqq 3.0\times j$). The bulk density (J; dtex/cm) of the elastic yarns is calculated as the product of the average fineness (T; dtex) and the density of the arrangement (G=n/L; number/cm) of the elastic yarns (11) which is calculated by dividing the number of elastic yarns (n; number) by the length (L; cm) in the direction (Y) orthogonal to the direction in which the elastic yarns (11) extend. In the same way, the bulk density (j; dtex/cm) of the intersecting yarns (22), which is an inelastic yarn, is calculated as the product of the average fineness (t; dtex) and density of the arrangement (g=m/L; number/cm) of the intersecting yarns (22) which is calculated by dividing the number of intersecting yarns (m; number) by the length (L; cm) in the lenghtwise direction (X) in which the elastic yarns (11) extend.

The reason to design the product (H×K) of the rate of intersection (H) and the covering rate (K) of the elastic yarn (11) to be more than 0.1 is to distribute the weight of limbs loaded on the elastic fabric between adjacent elastic yarns. Consequently, adjacent elastic yarns (11, 11) are not restricted tightly by the intersecting yarns (22) but come into contact with one another. The weight of the limbs is distributed over all of the elastic fabric, and then, undulatory puckers or crimps which would otherwise result from the tension stress of the intersecting yarns (22) do not appear over the elastic fabric.

The rate of intersection (H) of individual elastic yarns may vary in the textile, but the average rate of the intersection (H) of the elastic yarns is designed to be less than 0.5, and the product of the average rate of the intersection (H) and the covering rate (K) is designed to be more than 0.1. In the case where the fabric has several kinds of elastic yarns which are different in fineness, the average diameter (D) is calculate by dividing the sum of the diameters ($D_1+D_2+D_3+\ldots+D_n$) by the number of different kinds of elastic yarns.

The reason to design the bulk density (J; dtex/cm) of the elastic yarns (11) from 0.5 to 3.0 times the bulk density (j; dtex/cm) of the intersecting yarns (22) ($0.5\times j \leqq J \leqq 3.0\times j$) is to maintain balance between the weft yarns and the warp yarns. It is desirable to design the ratio (J/j) between the bulk density (J) of the elastic yarns (11) and the bulk density (j) of the intersecting yarns (22) to be between 1.0~2.5, and more preferably about 1.0.

To maintain the arrangement of the elastic yarns (11) in line, the intersecting yarns (22), which cross the elastic yarns (11), should be thinner than the elastic yarns (11). The density of the arrangement (g) of the intersecting yarns (22) should denser, and the ratio (J/j) between the bulk density (J) of the elastic yarns (11) and the bulk density (j) of the intersecting yarns (22) should between 0.5~3.0. Also, to maintain the arrangement of the elastic yarns (11) in line, it is desirable to use multi-fiber yarn made from multiple fibers as multifilament yarn, and spun yarn, for the intersecting yarns (22). Especially in the case where multi-fiber yarn is used for the intersecting yarns (22), the tension stress of the intersecting yarns (22) does not act to raise undulatory puckers or crimps over the elastic fabric. Although latent tension stress may be induced in the intersecting yarns (22) in the weaving process, this latent tension stress will gradually disappear with the passage of time if multi-fiber yarns are used, even if the number of the elastic yarns (11) which might be included between the intersections (20*m*, 20*n*) are numerous and the intersecting yarns (22) might be elongated by many elastic yarns (11) which exist between the intersections (20*m*, 20*n*). Thus, to make the elastic fabric dimensionally stable, it is desirable to use a multi-fiber yarn for the intersecting yarns (22).

Embodiment [A-1]

Figure 7:
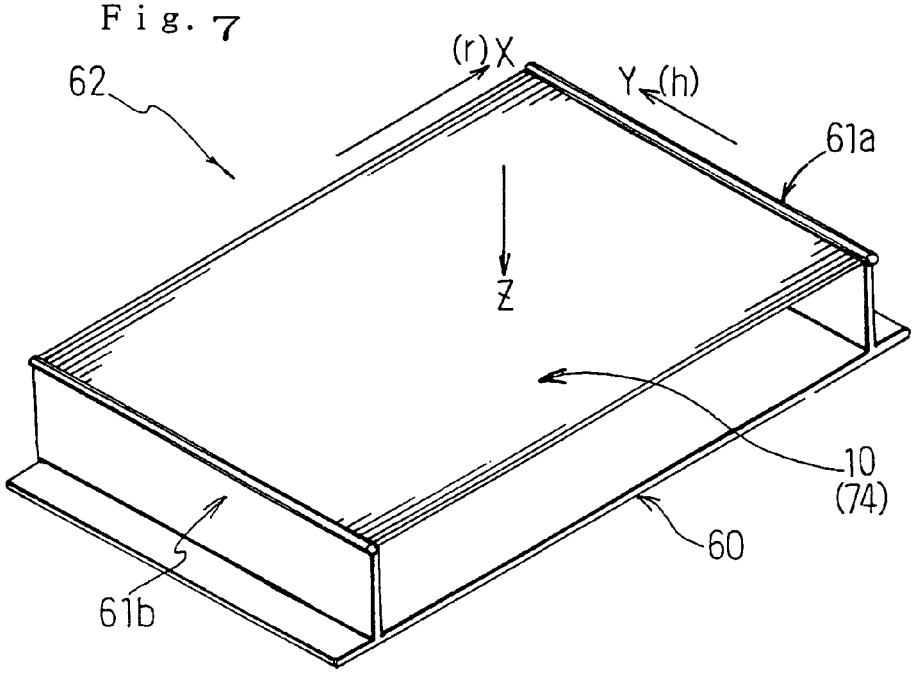
FIG. 7 is a perspective view of an elastic fabric in accordance with the present invention.

A polyester spun yarn (fineness: 2 ply/meter count of 10 in single yarn) is set in the warp direction with a density of 55/10 cm. A thermo adhesible sheath core conjugate polyetherester yarn (fineness: 2080 dtex, having the product name of "Dia-Flora" and is available from Toyobo Co. Ltd.) is used for the weft yarn. This "Dia-Flora" is composed of an elastic core component and a thermo adhesive sheath component of which the melting point is lower than the elastic core component. The fabric is woven in a herring-bone twill weave as shown in FIG. 4, and is woven with a weft density of 155/10 cm. The woven fabric is finished as an elastic woven fabric by passing it through a dry-heating treatment at 190° C. for 3 minutes and by thermally adhering the warp yarns (11) and the weft yarns (22). The elastic cover material (62) is formed by hanging the elastic woven fabric (10) between frame parts and by fixing both edges of the fabric to the frame parts (61*a*, 61*b*) which are positioned at both sides of a frame (60) apart from one another 50 cm and are located opposite to one another (FIG. 7). The length of the frame part is 45 cm. The fabric (10) was tested by having a subject sit on it. As a result, the elastic woven fabric (10) was judged to effect a stable and comfortable feeling.

Comparison [A-1]

Figure 8:
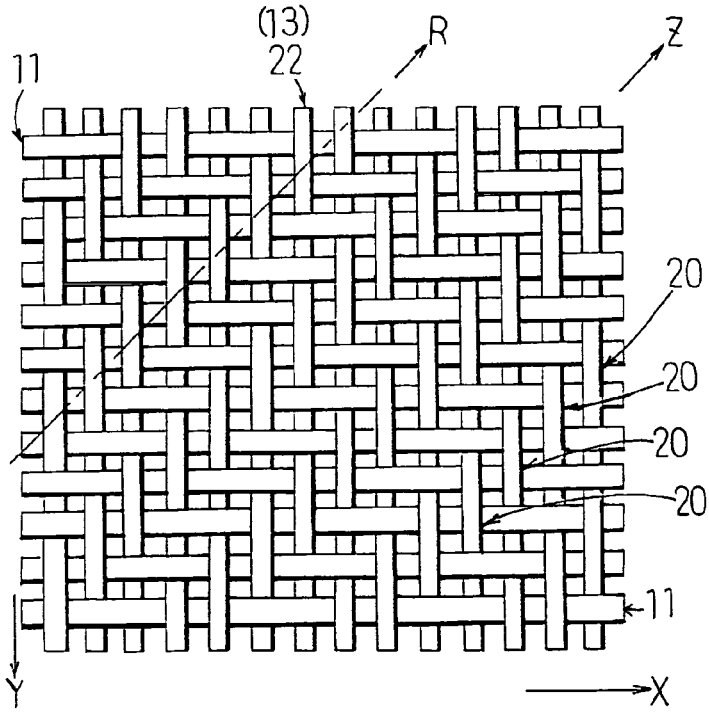
FIGS. 8 and 9 are plan views of conventional elastic fabric weaves in accordance with the prior art.

A polyester spun yarn (fineness: 2 ply/meter count of 10 in single yarn) is set in the warp direction with a density of 55/10 cm. The above-mentioned thermo adhesible sheath core conjugate elastic polyether-ester "Dia-Flora" used in the Embodiment [A-1] is used for the weft yarn. The fabric is woven in a twill weave, as shown in FIG. 8, and is woven with a weft density of 155/10 cm. The woven fabric is finished as an elastic woven fabric by passing it through a dry-heating treatment at 190° C. for 3 minutes and by thermally adhering the warp yarns (11) and the weft yarns (22). The elastic cover material (62) is formed by hanging the elastic woven fabric (10) between frame parts and by fixing both edges of the fabric to the frame parts (61*a*, 61*b*) which are positioned at both sides of the frame (60) apart from one another 50 cm and located opposite to one another (FIG. 7). The length of the frame part is 45 cm. The fabric was tested by having a subject sit on it. As a result, the elastic woven fabric (10) was observed to have a difference of elongation between the leftwise bias direction and the rightwise bias direction which effected an unstable feeling, and was not comfortable.

Comparison [A-2]

A polyester multifilament yarn (fineness: 1333 dtex) is set in the warp direction with a density of 91/10 cm.

The above-mentioned thermo adhesible sheath core conjugate elastic polyether-ester yarn "Dia-Flora" used in the Embodiment [A-1] is used for the weft yarn.

The fabric is woven in a twill weave, shown in FIG. 8, with a weft density of 155/10 cm.

The woven fabric is finished as an elastic woven fabric by passing it through a dry-heating treatment at 190° C. for 3 minutes and by thermally adhering the warp yarns (11) and the weft yarns (22).

The elastic cover material (62) is formed by hanging the elastic woven fabric (10) between frame parts and by fixing both edges of the fabric to the frame parts (61*a*, 61*b*) which are positioned at both sides of a frame (60) apart one another 50 cm and are located opposite to one another (FIG. 7).

The length of the frame part is 45 cm.

The fabric (10) was tested by having a subject sit on it.

As a result, the elastic woven fabric (10) was observed to raise a difference of elongation between the leftwise bias direction and the rightwise bias direction, effect an unstable and hard feeling, and was uncomfortable.

Comparison [A-3]

A polyester spun yarn (fineness: 2 ply/meter count of 10 in single yarn) is set in the warp direction with a density of 55/10 cm.

The above mentioned thermo adhesible sheath core conjugate elastic polyether-ester yarn "Dia-Flora" is used in the Embodiment [A-1] is used for the weft yarn.

Figure 9:
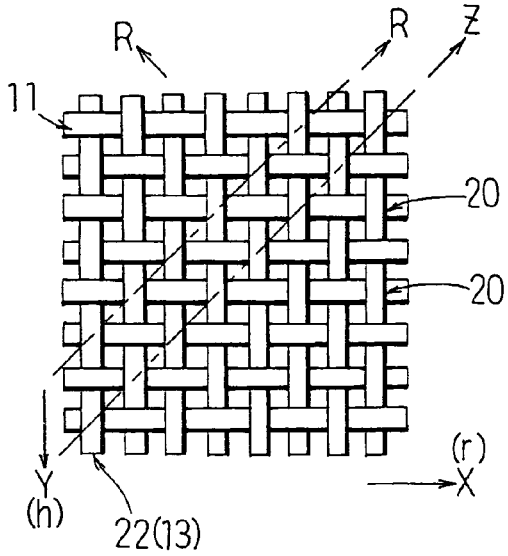

The fabric is woven in a plain weave, shown in FIG. 9, is woven with a weft density of 100/10 cm.

The woven fabric is finished as an elastic woven fabric by passing through a dry-heating treatment at 190° C. for 3 minutes and by thermally adhering the warp yarns (11) and the weft yarns (22).

The elastic cover material (62) is formed by hanging the elastic woven fabric (10) between frame parts and by fixing both edges of the fabric to the frame parts (61*a*, 61*b*) which are positioned at both sides of a frame (60) apart from one another 50 cm and are located opposite to one another (FIG. 7).

The length of the frame part is 45 cm.

The fabric (10) was tested by having a subject sit on it.

As a result, the elastic woven fabric (10) was observed not to raise a difference of elongation between the leftwise bias direction and the rightwise bias direction, but it effected an unstable and hard feeling, as well as a sticky feeling and was uncomfortable since the elastic fabric sagged significantly as a whole.

Property Datum of Embodiment and Comparison [A]

The following parameters for the above-mentioned embodiment and comparisons are shown in the following Table 1:

(i) stress at 10% elongation ($F_1$; N/5 cm) in the direction (X) where the elastic yarns (11) extend, (ii) rate of hysteresis loss ($\Delta E_1$) at 10% elongation in the direction (X) where the elastic yarns (11) extend, (iii) stress at 10% elongation ($F_2$; N/5 cm) in the orthogonal direction (Y) to the direction (X) where the elastic yarns (11) extend, (iv) the rate of hysteresis loss ($\Delta E_2$) at 10% elongation in the orthogonal direction (Y) to the direction (X) where the elastic yarns (11) extend, (v) 10% elongation stress ($B_1$; N/5 cm) in the 45 degree leftwise bias direction ($Z_1$) which has a left-wise inclination of 45 degrees to the direction (X), (vi) stress at 10% elongation ($B_2$; N/5 cm) in the 45 degree rightwise bias direction ($Z_2$) which has a rightwise inclination of 45 degrees to the direction (X), (vii) bulk density (J; dtex/cm) of the elastic yarns (11), (viii) bulk density (j; dtex/cm) of the inelastic yarns (22), (ix) ratio (J/j) between the bulk density (J) of the elastic yarns (11) and bulk density (j) of the intersecting inelastic yarns (22), (x) the covering rate (K) of the elastic yarns (11), (xi) the rate of intersection (H) of the elastic yarns (11), and (xii) the product (HX K) of the rate of intersection (H) and the covering rate (K) of the elastic yarns (11) of the elastic fabrics (10).

TABLE 1

| | embodiment A-1 | comparison A-1 | comparison A-2 | comparison A-3 |
|---|---|---|---|---|
| stress at 10% elongation in the direction(X) ($F_1$; N/5 cm) | 350 | 351 | 360 | 331 |
| rate of hysteresis loss in the direction(X) ($\Delta E_1$) | 30 | 32 | 28 | 35 |
| stress at 10% elongation in the orthogonal direction(Y) ($F_2$; N/5 cm) | 147 | 152 | 320 | 58 |
| rate of hysteresis loss in the orthogonal direction(Y) ($\Delta E_2$) | 42 | 41 | 42 | 28 |
| stress at 10% elongation in leftwise bias direction($Z_1$) ($B_1$; N/5 cm) | 26 | 33 | 109 | 37 |
| stress at 10% elongation in rightwise bias direction($Z_2$) ($B_2$; N/5 cm) | 25 | 20 | 86 | 38 |
| bulk of the elastic yarn (J; dtex/cm) | 23920 | 23920 | 23920 | 20800 |
| bulk of the inelastic yarn (j; dtex/cm) | 11000 | 11000 | 12130 | 11000 |
| ratio of density(J) and density(j) (J/j) | 2.17 | 2.17 | 1.97 | 1.89 |
| covering rate of the elastic yarn (K) | 52 | 52 | 52 | 46 |
| rate of an intersection of the elastic yarn (H) | 0.5 | 0.5 | 0.5 | 1.0 |
| product value of rate of intersection(H) and covering rate(K) (H × K) | 0.26 | 0.26 | 0.26 | 0.46 |
| estimation | good | normal | bad | bad |

Weft knitted fabric is more stretchable than both warp knitted fabric and woven fabric. It sags excessively and effects a cramped and unstable feeling when supporting limbs. When forming an elastic fabric (10) as a weft knitted fabric, it is advantageous if an inelastic yarn (13) is used as a base knit and an elastic yarn (11) is knitted in the base in a manner where the elastic yarn continues in line in the knitting width direction (r) over at least a plurality of wales of at least one course so that its stress at 10% elongation (F) in the knitting length direction (Σ) can be more than 25N/5 cm. In this case, the bulk density (J; dtex/cm) of the elastic yarn is calculated as the product of the average fineness (T; dtex) of the elastic yarns (11) and the density of the arrangement (G; number/cm) of the elastic yarns (11) which are arranged in the knitting length direction (Σ) and is more than 17000 dtex/cm ($J \geqq 17000$ dtex/cm).

In this case, stress at 10% elongation (B) in the 45 degree bias direction (Z), which has an inclination of 45 degrees to the direction (X) of the elastic yarns (11) is more than 5% and less than 20% of the stress at 10% elongation (F) in the direction (X) of the elastic weft knitted fabric ($0.05\times F \leqq B \leqq 0.20$).

Figure 10:
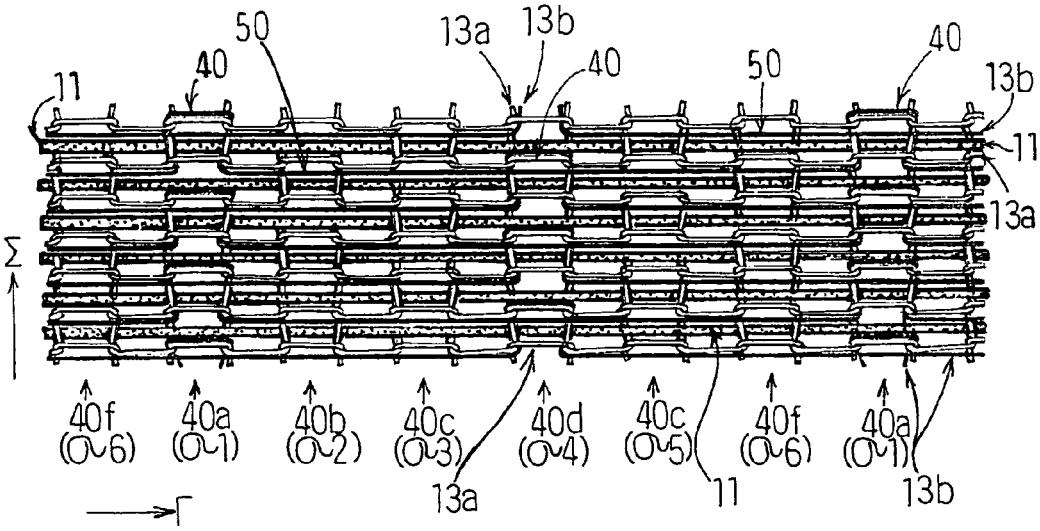
FIGS. 10-20 are perspective views of elastic fabrics in accordance with the present invention.

To knit an elastic yarn (11) in the base fabric in a manner where the elastic yarn continues in line in the knitting width direction (Γ) over at least a plurality of wales means that the elastic yarn may be knitted to form needle loops together with inelastic yarns every wale in a manner that continues in line in the knitting width direction (Γ) such that the second inelastic yarn (13*b*) forms needle loops together with the first inelastic yarns (13*a*) over a plurality of wales and continues without forming a needle loop over the wales as shown in FIG. 10. In the case where the elastic yarn is knitted to form needle loops together with an inelastic yarn over every wale, it is possible to avoid forming the portion of the elastic yarn which continues in line over the wales without forming a needle loop slip aside from the knitting width direction (Γ). On the other hand, slippings of the needle loops and sinker loops formed of the inelastic yarns are restrained by the elastic yarns and sagging of the elastic fabric due to the weight of limbs increases. Then, the lower stretching elastic fabric which does not effect a painful cramped feeling can be obtained.

Figure 11:
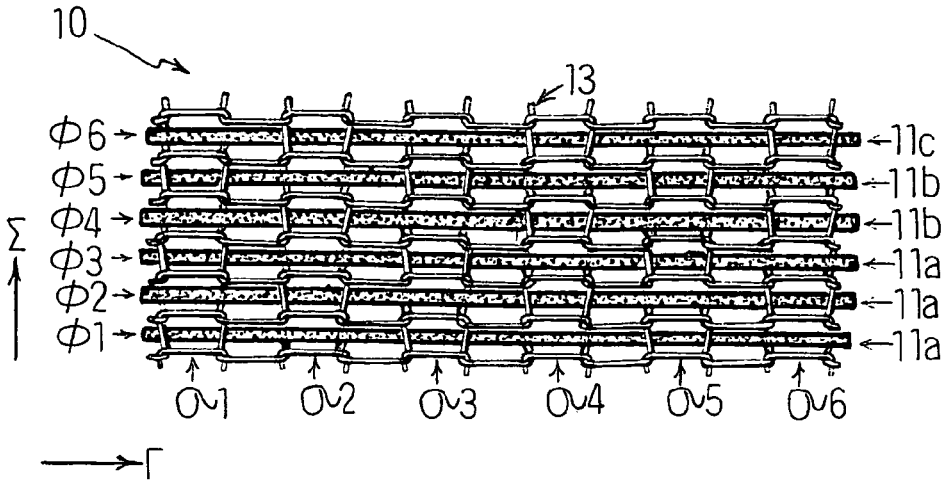

The textile design is not limited to a particular form of knitting. Plain stitch knitting, rib stitch knitting and purl stitch knitting may be used to form the base knitted fabric. The base knitted fabric formed as a plain stitch using a weft knit (10) is shown in FIG. 11 and is formed from the inelastic yarns (13) which are knitted in by replacing floating wales (σ1, σ2, σ3) every one course. In the courses (ϕ1, ϕ2, ϕ3), the first elastic yarn (11*a*) is inserted in the space between needle loops (40, 40) of adjacent wales (σ1, σ2). In the course (ϕ4, ϕ5), the first elastic yarn (11*a*) and the second elastic yarn (11*b*) which have different elasticities are inserted in the space between needle loops (40, 40) of adjacent wales (σ1, σ2). In the course (ϕ6), the first elastic yarn (11*a*), the second elastic yarn (11*b*) and the third elastic yarn (11*c*) which have different elasticities are inserted in the space between needle loops (40, 40) of adjacent wales (σ1, σ2).

In the case of the weft knitted fabric (10) shown in FIG. 10, a float stitch knitting textile is formed from second inelastic yarns (13*b*). The second inelastic yarns (13*b*) form a needle loop together with the first inelastic yarns (13*a*) every 6 needle loops (40*a*, 40*b*, 40*c*, 40*d*, 40*e*, 40*f*) in the course where the first inelastic yarn (13*a*) is knitted in. The sinker loop (50), which is formed from the second inelastic yarn (13*b*), extends in the knitting width direction (Γ) over 5 wales (σ2, σ3, σ4, σ5, σ6/σ5, σ6, σ1, σ2, σ3) from the needle loop formed together with the first inelastic yarn (13*a*) and the second inelastic yarn (13*b*) to other needle loops formed together with the first inelastic yarn (13*a*) and the second inelastic yarn (13*b*).

In the case of the weft knitted fabric (10) shown in FIG. 10, the second inelastic yarn (13*b*) does not form needle loops over several wales. Therefore, the elongation of the elastic yarn (11) is restrained by the second inelastic yarn (13*b*). Thus, the lower stretching elastic fabric, which does not cause undulating puckers or crimps and which does not effect a painful cramped feeling, can be obtained.

In the case of the weft knitted fabric (10) shown in FIG. 10, the elastic yarn (11) is inserted in the space between needle loops of adjacent wales (σ1, σ2) on every other course (ϕ2, ϕ4, ϕ6) of the base knitted fabric which is formed from the inelastic yarn (13) by using a rib stitch knit and by replacing floating wales (σ1, σ2, σ3) every course.

Figure 12:
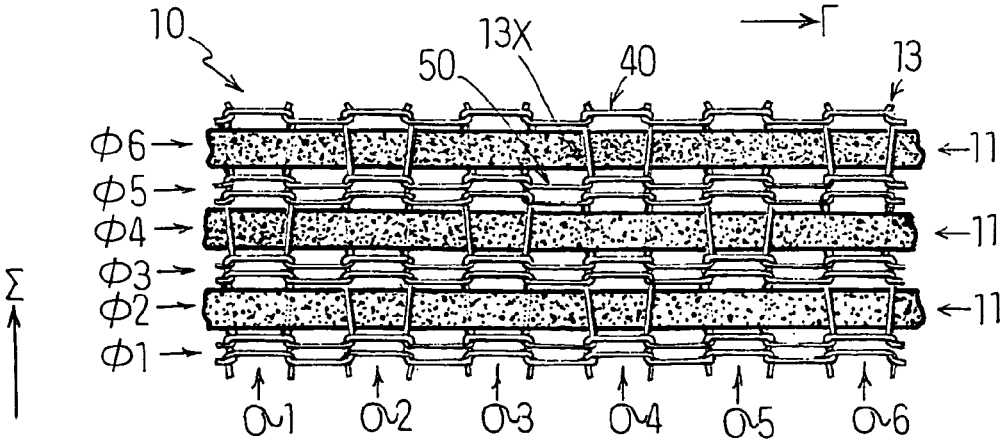
Figure 13:
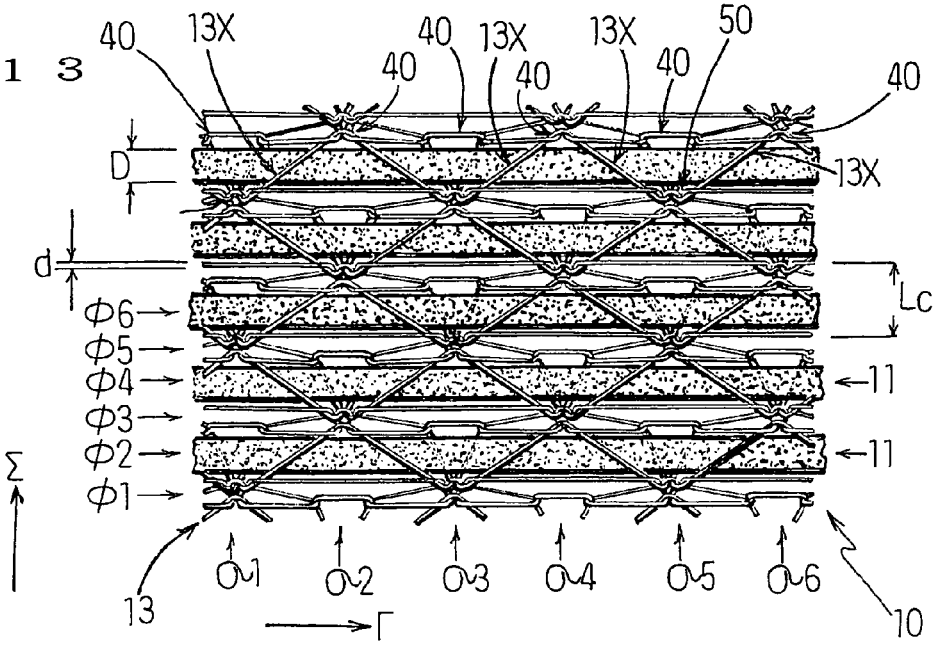

FIG. 12 shows the positional relationship of the needle loops (40) and the sinker loops (50) of the inelastic yarn (13) and the elastic yarn (11) which may be drawn in the knit wherein the needle loop and the sinker loop are drawn in the same shape. However, the appearance of the needle loop (40) and the sinker loop (50) of the weft knitted fabric are not the same. FIG. 13 shows the appearance of the weft knitted fabric which may be knitted according to the design shown in FIG. 12. That is, in the weft knitted fabric shown in FIGS. 12 and 13, (i) the average diameter of the elastic yarn (11) may be more than 1.5 times the average diameter of the inelastic yarn (13).

(ii) the average diameter of the elastic yarn is more than 1.1 times the average course interval (Lc) of the weft knitted fabric that is equal to the sum of the average diameter of the elastic yarn (11) and average diameter of the inelastic yarn (13), (iii) the needle loops (40) and the sinker loops (50) are pushed out from the course (ϕ2) toward the other adjacent course (ϕ1, ϕ3), where the elastic yarn is not threaded in where loops are formed and the elastic yarn is threaded in by the elastic yarn (11) which is threaded in its course (2).

(iv) the portions (13*x*) of the inelastic yarn (13) on the course (ϕ2) is inclined to the knitting width direction (Γ) and the knitting length direction (Σ).

(v) the inclined portions (13*x*) form a Λ-shaped appearance.

Therefore, a diamond pattern is drawn on the surface of the elastic weft knitted fabric by the portions (13*x*) of the inelastic yarn (13).

To this end, (i) the average diameter of the elastic yarn (11) is more than 1.5 times the average diameter of the inelastic yarn (13), (ii) the average diameter of the elastic yarn is more than 1.1 times of average course interval (Lc) of the weft knitted fabric that is equal to the sum of the average diameter of the elastic yarn (11) and the average diameter of the inelastic yarn (13), (iii) the inelastic yarn is elongated where the tension induced in the inelastic yarn in the knitting process is stored inside of the inelastic yarn as latent tension stress, (iv) the inelastic yarn does not return to its original relaxed length disturbed by the thick elastic yarn after the fabric is taken out from the weft knitting machine, (v) the elongation of the inelastic yarn is maintained by the thick elastic yarn.

That is, the elastic yarn;

(vi) is established in the course (ϕ2) as a wedge picked in between the front course (ϕ1) and the rear course (ϕ3), (vii) widens the space between these two courses (ϕ1, ϕ3) and stretches the needle loops (40) and the sinker loops (50) formed in the course (ϕ2), then (viii) the needle loops (40) and the sinker loops (50) formed in the course (ϕ2) pull both front and rear needle loops (40) and sinker loops (50) formed in both front and rear courses (ϕ1, ϕ3) toward the course (ϕ2) and stretch these loops (40, 50). As above, since the elastic yarn (11) is inserted in the course (ϕ2) as a wedge and stretches the base knitted fabric through the needle loops and the sinker loops, the base knitted fabric, which is formed from inelastic yarns (13) and is telescopic in itself as a weft knitted products, is knitted up in telescopic. On the other hand, since the elastic yarn (11) is thicker than the inelastic yarn (13), it is hardly elongated in the knitting process, so that, it is not fixed in elongation through the knitting process, its elastic property is maintained after the knitting process. In this manner, the lower stretching elastic weft knitted fabric which does not effect a painful cramped feeling can be obtained.

Thick elastic monofilament yarn for which the fineness is more than 500 dtex, and preferably more than 1000 dtex, and further preferably more than 1650~3000 dtex and which has stress at 10% elongation of more than 0.1 cN/dtex, preferably 0.3~0.8 cN/dtex, is used for the elastic yarn (11) and is knitted in without significant elongation in the knitting process.

Embodiment [B-1]

An inelastic polyester multifilament yarn (fineness: 500 dtex) is applied to the base stitch yarn (13). The base knitted fabric is knitted using a plain stitch, shown in FIGS. 12 and 13, having a density in the wale direction of 12 wales/25.4 mm and density in the course direction of 44 courses/25.4 mm. The above-mentioned thermo adhesible sheath core conjugate elastic polyether-ester yarn "Dia-Flora" used in the Embodiment [A-1] is used for the inserted yarn (11). The inserted yarn (11) is interknitted in line weftwise every other course (ϕ2, ϕ4, ϕ6) in a manner where it passes over one needle loop (40) and passes under the next one needle loop (40) of the base knitted fabric. The weft knitted fabric is finished as an elastic weft knitted fabric by passing it through a dry-heating treatment at 190° C. for 3 minutes. In this manner, an elastic weft knitted fabric is obtained having an inserted yarn thermally adhered to the base knitted fabric.

Comparison [B-1]

An inelastic polyester multifilament yarn (fineness: 500 dtex) is applied to the base stitch yarn (13).

The base knitted fabric is knitted in a plain stitch, shown in FIGS. 12 and 13, with a density the wale direction of 12 wales/25.4 mm and a density in the course direction of 44 courses/25.4 mm.

The above-mentioned thermo adhesible sheath core conjugate elastic polyether-ester yarn "Dia-Flora" used in the Embodiment [A-1] is used for the inserted yarn (11).

The inserted yarn (11) is interknitted in line weftwise every other course (ϕ2, ϕ4, ϕ6) in a manner where it passes over one needle loop (40) and passes under the next one needle loop (40) of the base knitted fabric.

The weft knitted fabric is used for a elastic top material without dry-heating treatment.

Comparison [B-2]

An inelastic polyester multifilament yarn (fineness: 667 dtex) is applied to the base stitch yarn (13).

The base knitted fabric is knitted using a plain stitch, shown in FIG. 10, with a density in the wale direction of 12 wales/25.4 mm and a density in the course direction of 44 courses/25.4 mm.

The above-mentioned thermo adhesible sheath core conjugate elastic polyether-ester yarn "Dia-Flora" used in the Embodiment [A-1] is used for the inserted yarn (11).

The inserted yarn (11) is interknitted in every third courses (ϕ2, ϕ5) of 6 courses (ϕ1, ϕ2, ϕ3, ϕ4, ϕ5, ϕ6) in line weftwise in a manner where it passes over one needle loop (40) and passes under the next one needle loop (40) of the base knitted fabric.

The weft knitted fabric is finished up as an elastic weft knitted fabric by passing through dry-heating treatment at 190° C. for 3 minutes.

In this manner, an elastic weft knitted fabric where the inserted yarn thermally adhered to the base knitted fabric is obtained.

Property Datum of Embodiment and Comparison [B]

The elastic cover material (62) is formed by hanging the elastic weft knitted fabric (10) obtained in above Embodiment [B-1], Comparison [B-1] and Comparison [B-2] between frame parts, of a frame (60) preferably made of aluminum pipe and having a length of 40 cm, where these frame parts are separated 40 cm. The test to determine cramped feeling, stable feeling, hardness, painful feeling and fatigued feeling is executed on the elastic top material (62) by sitting on the elastic fabric for 10 minutes.

In the case of the elastic fabric of Embodiment [B-1], the portion where it touches the buttocks sagged slightly, the resistance of the sagged portion was not so hard, and cramped feeling, unstable feeling, hardness, painful feeling and fatigued feeling were not felt.

In the case of the elastic fabric of Comparison [B-1], it elongated significantly in the knitting length direction, the portion where it touched the buttocks sagged significantly, and the periphery of the sagged portion effected a cramped feeling, a sticky feeling, and a fatigued feeling.

In the case of the elastic fabric of Comparison [B-2], even though a sticky feeling was not felt to the same degree as the case of Comparison [B-1], due to a roughness of the density of the arrangement of the elastic yarn, the portion where it touched the buttocks sagged significantly as a whole, and an unstable feeling was felt.

For the results shown in Table 2 below:

(i) stress at 10% elongation (FC; N/5 cm) in the knitting width direction (Γ), (ii) stress at 10% elongation (FC; N/5 cm) in the knitting length direction (Σ), (iii) the rate of hysteresis loss ΔE which is calculated by the equation $\Delta E=100\times C/V=100\times(V-W)/V$;

wherein V is an integral value which is calculated by integrating the load-reducing equation ($f_1(\rho)$), which is defined by the reducing curve ($f_1$) of the hysteresis in the load-elongation diagram, from 0% to 10% elongation in the knitting width direction (Γ). W is an integral value which is calculated by integrating the load-elongation equation ($f_0(\rho)$), which is defined by the loading curve ($f_0$) of the hysteresis in the load-elongation diagram, from 0% to 10% elongation in the knitting width direction (Γ).

$C=V-W$ is the value of hysteresis loss which is calculated as the difference between the integral values V and W.

(iv) estimation in the test of the elastic fabrics (10) in the above-mentioned embodiment and comparison are shown in the following table (2).

TABLE 2

| | embodiment B-1 | comparison B-1 | comparison B-2 |
|---|---|---|---|
| stress at 10% elongation in the direction (Γ) (FC; N/5 cm) | 392 | 349 | 277 |
| stress at 10% elongation in the direction (Σ) (FW; N/5 cm) | 35 | 10 | 23 |
| density of wale (wales/cm) | .9 | .9 | .9 |
| density of arrangement elastic yarn (number/cm) | .98 | .98 | .94 |
| bulk of elastic yarn (J) (dtex/cm) | 18678 | 18678 | 14435 |
| average course interval (Lc) (mm) | .58 | .58 | .77 |

TABLE 2-continued

| | embodiment B-1 | comparison B-1 | comparison B-2 |
|---|---|---|---|
| fineness of inelastic yarn (dtex) | 500 | 500 | 667 |
| average diameter of inelastic yarn (d) (mm) | .224 | .224 | .258 |
| fineness of elastic yarn (T) (dtex) | 2080 | 2080 | 2080 |
| average diameter of elastic yarn (D) (mm) | .458 | .458 | .458 |
| rate of sum of diameter of elastic yarn and inelastic yarn (D + d) to course interval(Lc) (D + d) ÷ Lc | .18 | .18 | .97 |
| rate of hysteresis loss in the direction(Γ) ΔE (%) | 35 | 44 | 34 |
| adhered situation of yarn in fabric | adhered | unadhere | adhered |
| estimation by sensory test | good | bad | bad |

Sagging of the surface of the elastic fabric (10) and reaction from the elastic fabric (10) are partially changable according to the manner in which the elastic fabric (10) is stretched and loaded. To avoid this problem, it is desirable to form the elastic fabric (10) in a three-dimensional construction with a face fabric (32) formed from face yarns (31) and a back fabric (34) formed from back yarns (33) and to apply the elastic yarn (11) to the back yarns (33) at least as one kind of yarn.

Accordingly, the elongation of the elastic yarn applied to the back fabric is restrained by the face fabric formed from the inelastic yarn. The three-dimensional elastic cover material which does not partially elongate and sag is useful for sofas and mattresses.

Figure 14:
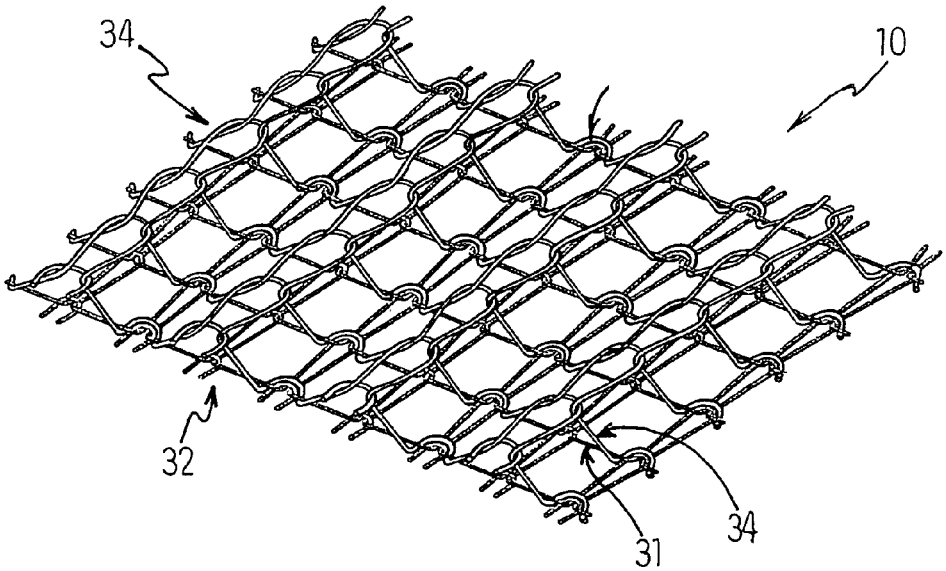
Figure 15:
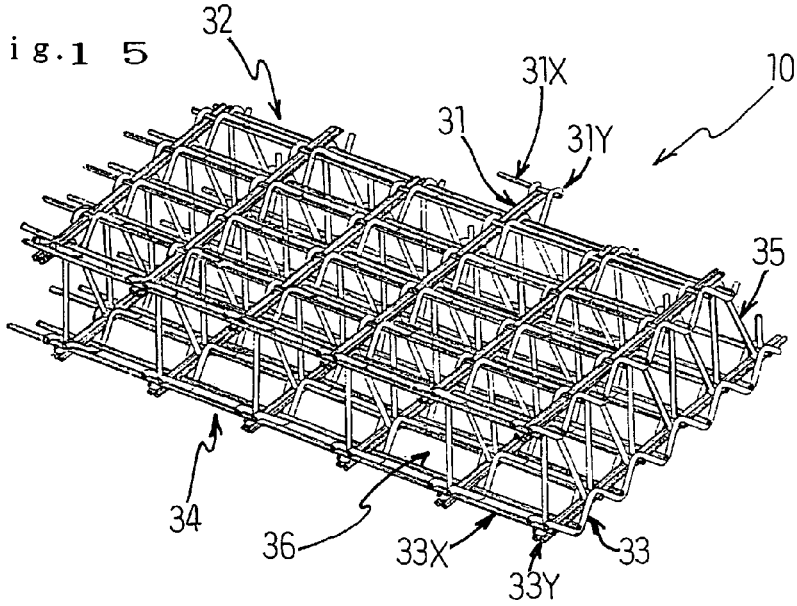

In the case of forming the elastic fabric (10) in three-dimensional constructions, in the weaving or knitting process, the face fabric (32) and the back fabric (34) are simultaneously woven or knitted and are connected by one kind of face or back yarns. In the case of weaving, three-dimensional elastic double fabric may be woven as one kind of warp-weft-double woven fabrics by using a conventional loom. Three-dimensional elastic double fabric knitted by using the weft knitting machine is shown in FIG. 14. At one portion of the fabric, a double stitch opening is formed with the face yarn (31) and the back yarn (33). The face fabric (32) and the back fabric (34) are connected through the double stitch opening. Between the face fabric (32) and the back fabric (34), the interspace stratum (36) is formed. Three-dimensional elastic double fabric woven by using the double moquette loom is shown in FIG. 15. The face fabric (32) is formed in a plain weave textile design with the face warp yarn (31*y*) and the face weft yarn (31*x*). The back fabric (34) is formed in a plain weave textile design with the back warp yarn (33*y*) and the back weft yarn (33*x*). The interspace stratum (36) is formed between the face fabric (32) and the back fabric (34) which are connected by the connecting yarn (35).

Figure 16:
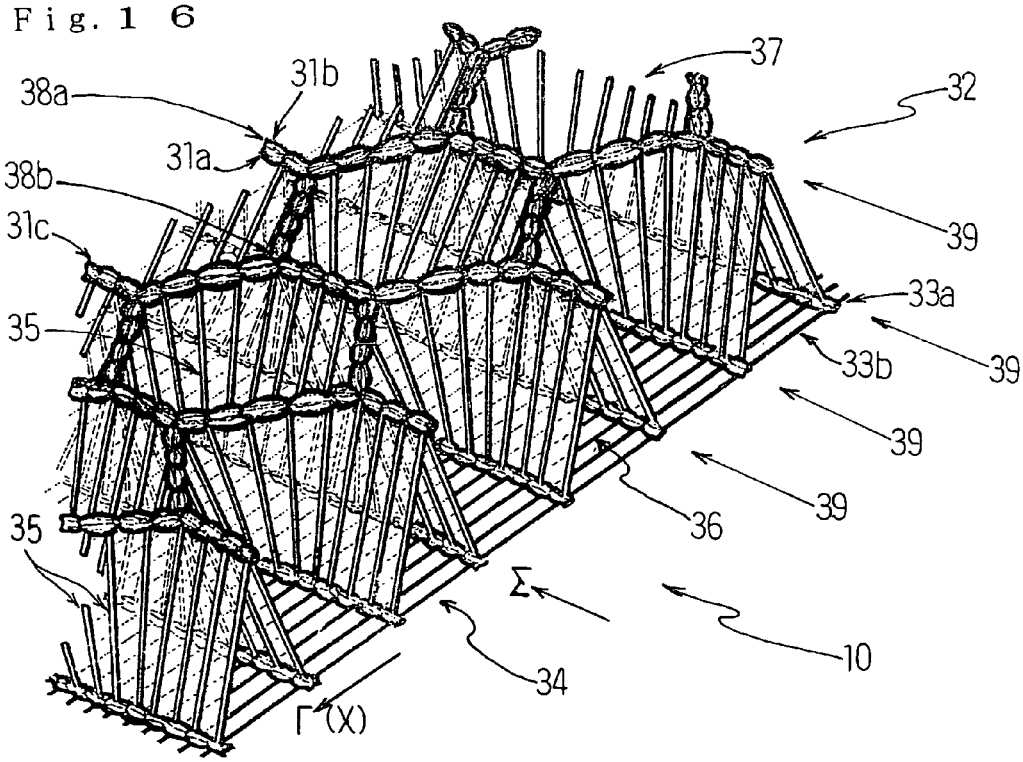

Three-dimensional elastic double fabric knitted by using the double raschel warp knitting machine is shown in FIG. 16. The face fabric (32) and the back fabric (34) are connected by the connecting yarn (35). The thickness of the interspace stratum (36) formed between the face fabric (32) and the back fabric (34) may be more than 0.3 mm. The elastic yarn is used for the back yarn (33) and the connecting yarn (35), and the inelastic yarn is used for the face yarn (31). The face yarns (31) form two kinds of chain stitch openings (38*a*, 38*b*) alternating every several courses. The two kinds of chain stitch openings (38*a*, 38*b*) are formed over several courses. One of the two kinds of chain stitch openings (38*a*) is formed together with one of the face yarns (31*a*) and the other face yarn (31*b*) which is adjacent to the left side of the one face yarn (31*a*) in the knitting width direction (Γ). Another one of the two kinds of chain stitch openings (38*b*) is formed together with the one face yarn (31*a*) and another face yarn (31*c*) which is adjacent to the right side of the one face yarns (31*a*) in the knitting width direction (Γ). Consequently, these two kinds of chain stitch openings (38*a*, 38*b*) form the chain stitch opening row (39) extending in the knitting length direction (Σ) in a zigzag manner. And, openings (37) having an opening area more than 1 $mm^2$ are formed between adjacent chain stitch opening rows (39, 39). Three-dimensional elastic double fabric is knitted up in mesh shape as a knitted net fabric. The back fabric (34) is formed with the ground stitch back yarn (33*a*) for forming the chain stitch opening row (39) extending in the knitting length direction (Σ) and the inserted back yarn (33*b*) is applied for connecting adjacent chain stitch opening rows (39, 39) without forming a needle loop.

Three-dimensional elastic double fabric has superior insulating properties because the interspace stratum (36) having bag like openings is formed between the face fabric (32) and the back fabric (34). In the three-dimensional elastic double fabric, even though the back fabric (34) may be thick, the softness of the face fabric (32) is not adversely affected. Even though the face fabric (32) may be formed in a mesh shape as a knitted net fabric, the shape of the face fabric (32) is stably maintained by the thick back fabric (34).

The elastic top material (62) which provides superior cushioning, is not sticky and is useful for sofas and mattresses, and may be obtained by using the three-dimensional elastic double fabric (10) wherein the thickness of the stratum (36) is more than 0.3 mm. Such thick three-dimensional elastic double fabric (10) provides superior cushioning, insulation, and air-permeability so that air flows out from and into the interspace stratum (36) every time it is compressed and expanded.

Thus, the three-dimensional elastic double fabric, of which the face fabric is formed in a mesh shape, is suitable for sofas and mattresses.

The three-dimensional elastic double fabric, wherein the elastic yarn (11) is used as the connecting yarn (35), provides superior cushioning, and is especially suitable for sofas and mattresses, and does not effect a sticky feeling.

Limbs of the human body cannot be supported comfortably on a cushioning surface when the surface is stretched under significant strain on a frame so as to maintain a planar surface.

In this regard, in accordance with the present invention, the tensile stresses, which are induced in the yarns in two mutually orthogonal directions and also cause elongation of the elastic fabric at a known rate, are distributed in relation to the deformation of the fabric. That is, the elasticity of the cushioning surface varies in a manner such that at one portion, where heavy loads act, the fabric sags significantly and forms a deep recess, while at another portion, where heavy loads do not act, the fabric sags less and forms a shallow recess. In such a manner, the cushioning surface accommodates the shape of limbs. In accordance with the present invention, the elastic cover material (10) does not cause pain and fatigue when limbs are put on the cushioning surface for a long time.

In the present invention, the tensile stress at the regular degree of elongation of the elastic fabric (hence called "regular tensile strength") is defined as the tensile stress which acts on the elastic fabric when it is elongated and its elongation reaches a degree of elongation that is necessary to compare the stretching elasticity of different portions of the cushioning surface which may be formed from the elastic fabric. It is preferable to set the "regular tensile strength" by the press load which is measured when the degree of elongation reaches the regular degree of elongation in a measuring process where the press load is applied to different portions of the cushioning surface where stretching elasticity is to be compared by increasing the press loads until the degree of elongation reaches the regular degree of elongation which may be between 3%~10% elongation.

Figure 17:
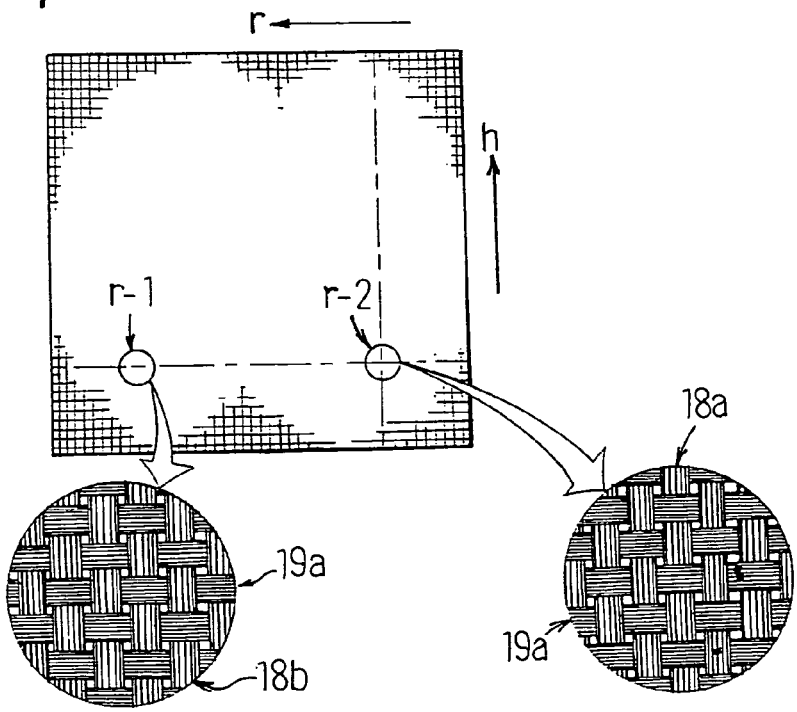

In the present invention, "portions spaced apart in at least two mutually orthogonal directions" means the following two portions;

(i) in the case of elastic fabric which is formed as a warp knitted fabric wherein the warp yarn (18) is continuous in the length direction (h) of the fabric, two portions (r-1, r-2) which are apart from one another in the width direction (r), that is, portion (r-1) formed with warp yarns (18*a*) is apart from portion (r-2) formed with other warp yarns (18*b*) (FIG. 17).

Figure 18:
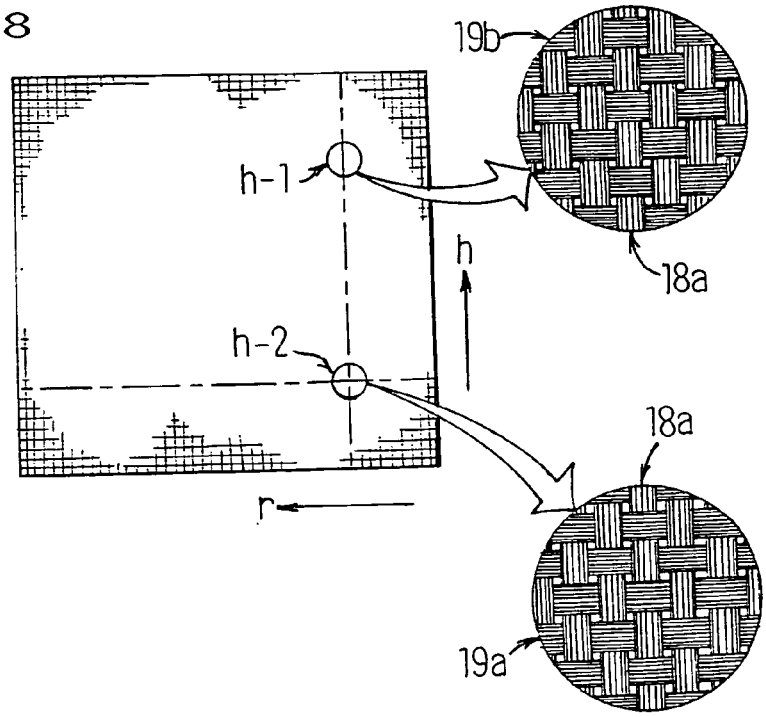

(ii) in the case of elastic fabric which is formed as a weft knitted fabric wherein the weft yarn (19) is continuous in the width direction (r) of the fabric, two portions which are apart from one another in the length direction (h), that is, portion (h-1) formed with weft yarns (19*a*) is apart from portion (h-2) formed with other weft yarns (19*b*) (FIG. 18).

Figure 19:
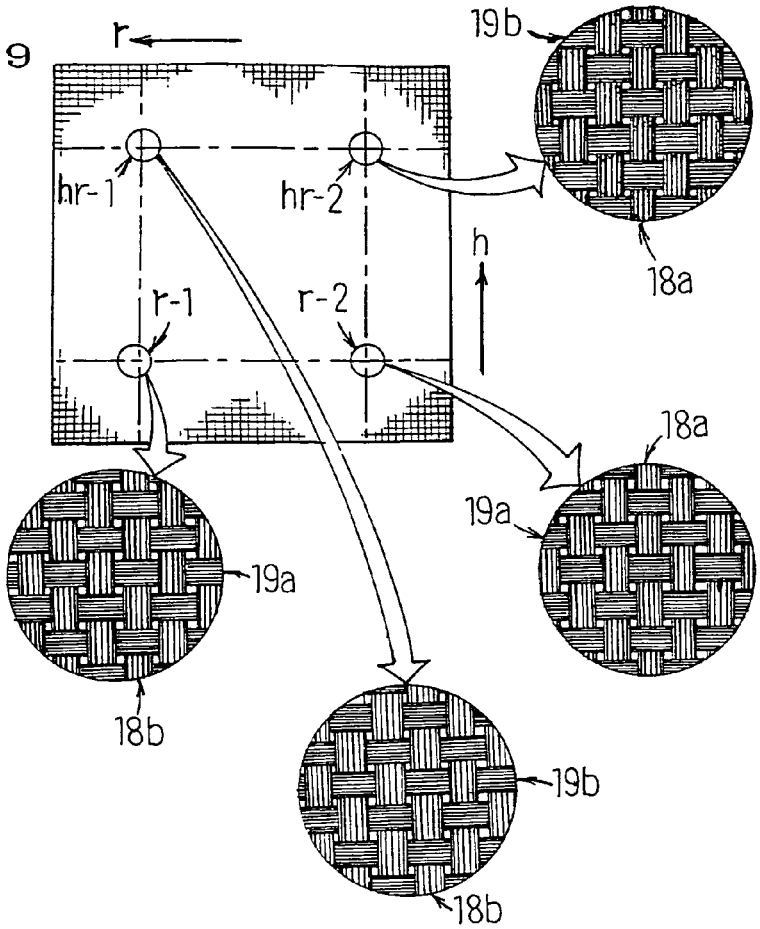

(iii) in the case of elastic fabric which is formed with warp yarns (18) which are continuous in the length direction (h) of the fabric and weft yarns (19) which are continuous in the width direction (r) of the fabric as a weft inserted warp knitted fabric and a woven fabric, two portions (r-1, r-2) which are apart from one another in the width direction (r) and another 2 portions (hr-1, hr-2) which are apart from one another in the length direction (h) of the fabric, that is, four portions (r-1, r-2, hr-1, hr-2) wherein the yarns are different in connection with either warp yarns (18) or weft yarns (19*b*) (FIG. 19).

As shown in FIG. 19, it is desirable for the partial variation of the regular tensile strength to be achieved using various kinds of yarn in different orthogonal directions. That is, for the partial variation of the regular tensile strength between two portions, two kinds of yarn are threaded in parallel into the two portions which are apart from one another in the direction where other yarn is continuous in its length direction and is orthogonal to the two kinds of yarn.

Two such portions can be shown in FIG. 19, wherein the elastic fabric is formed with the warp yarn (18) which is continuous in the length direction (h) of the fabric, and the weft yarn (19) which is continuous in the width direction (r) of the fabric, such as a weft inserted warp knitted fabric and a woven fabric. Therein, two kinds of yarn may be applied for the warp yarn (18) and the weft yarn (19). At either two portions (r-1, r-2) which are apart from one another in the width direction (r) or other two portions (hr-1, hr-2) which are apart from one another in the length direction (h) of the fabric, either the kind of warp yarns (18) of the portion (r-1) and the portion (r-2) or the kind of weft yarns (19) of the portion (hr-1) and the portion (hr-2) are varied.

In the present invention, two such portions being apart from one another in the direction orthogonal to the direction in which the regular tensile strength acts, that is, positions in which the regular tensile strength are different from one another, are called "regular strength different positions". In the case of the weft knitted fabric shown in FIGS. 10-13, the "regular strength different positions" are shown as the courses (ϕ1, ϕ2, ϕ3, ϕ4, ϕ5) where several different kinds of yarn can be selectively threaded in for varying the "regular tensile strength" according to the kinds of yarn. In the case of the elastic cover material (62) which is formed by fitting the knitting width direction (Γ) to the width direction of the frame (i) and by stretching and hanging the elastic weft knitted fabric (10) between frame parts (61*a*, 61*b*) (FIG. 20), it becomes possible to vary the "regular tensile strength" in the width direction at every portion in the depth direction (q).

In the cases of the warp knitted fabric and the warp inserted warp knitted fabric shown in FIGS. 1-3, the "regular strength different positions" are shown as the wales (σ1, σ2, σ3, σ4, σ5) where several kinds of yarn can be selectively threaded in to vary the "regular tensile strength" according to the kind of yarn. In the case of the elastic cover material (62) which is formed by fitting the knitting length direction (Σ) to the width direction of the frame (i) and by stretching and hanging the elastic weft knitted fabric (10) between frame parts (61*a*, 61*b*) (FIG. 20), it becomes possible to vary the "regular tensile strength" in the width direction at every portion in the depth direction (q).

In the case of the weft inserted warp knitted fabric shown in FIG. 2, the "regular strength different positions" are shown as the courses (ϕ1, ϕ2, ϕ3, ϕ4, ϕ5) where several kinds of yarn can be selectively threaded in for the variation of the "regular tensile strength" according to the kinds of yarn. Similarly, to vary the "regular tensile strength" of the wales (σ1, σ2, σ3, σ4, σ5), several kinds of yarn can be selectively threaded in, the variation being according to the kinds of yarn. Therefore, in the case of the elastic cover material (62) which is formed by fitting the knitting length direction (Σ) to the width direction of the frame (i) and by stretching and hanging the elastic knitted fabric between frame parts (61*a*, 61*b*) (FIG. 20), when the weft inserted warp knitted fabric wherein several kinds of yarn having different elasticity are selectively threaded in the wales (σ1, σ2, σ3, σ4, σ5), it becomes possible to vary the "regular tensile strength" of the cushioning surface (74) in the width direction at every portion in the depth direction (q) of the elastic cover material (62) (FIG. 2). Also, in the case of the weft inserted warp knitted fabric shown in FIG. 2, when it is knitted by selectively threading several kinds of yarn, which have different elasticity, into the wales or the courses, a check pattern with crosswise stripes (75) and lengthwise stripes (76) is formed depending on the difference of the kind of the yarn and the variation in the "regular tensile strength" which may act in both width and depth directions (i, q) at the "regular strength different positions" (FIG. 2). In the case of the weft inserted warp knitted fabric which is knitted by selectively threading several kinds of yarn, which have different elasticity, into the courses (ϕ1, ϕ2, ϕ3, ϕ4, ϕ5), when the weft inserted warp knitted fabric is stretched and hung between frame parts (61*a*, 61*b*) by fitting the knitting length direction (Σ) to the width direction of the frame (i), it is possible to vary the "regular tensile strength" in the depth direction (q), at every portion in the width direction (i).

For woven fabric, the "regular strength different positions" are different positions in the width direction (r) where several kinds of warp yarns (18) can be selectively arranged, and different positions in the weaving length direction (h) at which several kinds of weft yarn (19) can be selectively picked into the shed between warp yarns (18, 18). Therefore, the woven fabrics shown in FIGS. 17-19, are used for the elastic cover material, in the same way as the weft inserted warp knitted fabric shown in FIG. 2. A check pattern with crosswise stripes (75) and lengthwise stripes (76), a crosswise stripe pattern and a lengthwise stripe pattern may be formed depending on the difference between yarns, and the "regular tensile strength" which acts in both width and depth directions (i, q) at the regular strength different positions.

Figure 20:
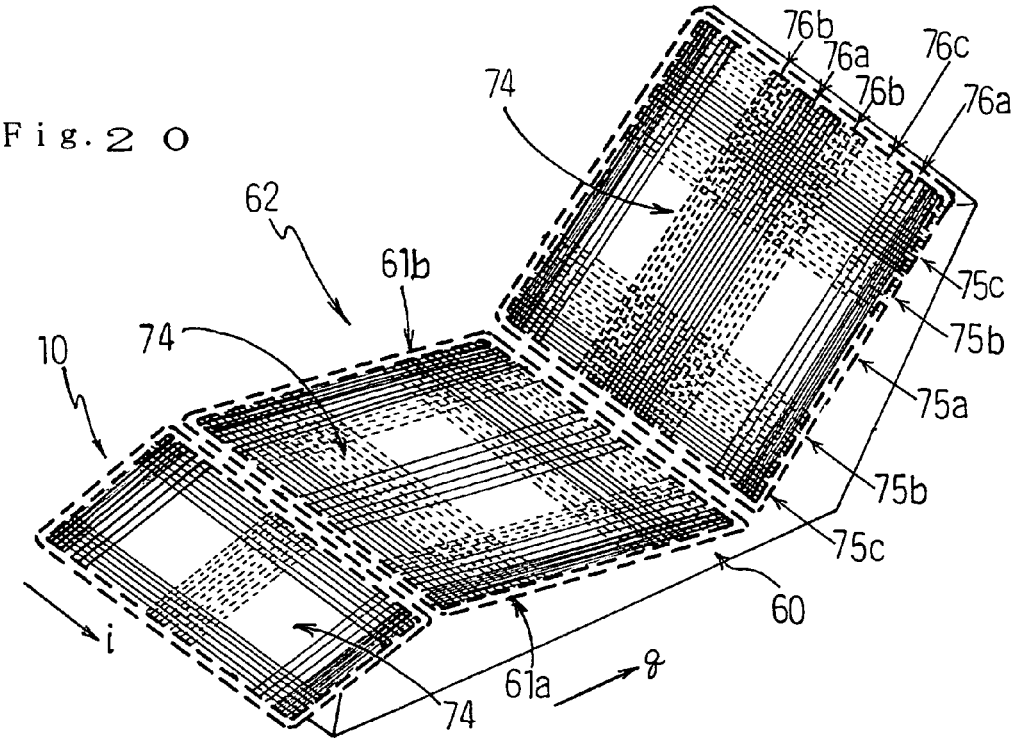

When several kinds of yarn are selectively applied to the "regular strength different positions" of elastic fabric, check patterns and stripe patterns tend to appear on the cushioning surface in accordance with differences of characteristics of the yarn such as finenesses, degree of twist, material and the like (FIG. 20).

To avoid such an appearance low stretch yarns and high stretch yarns, which are used, should be the same at the "regular strength different positions", and for both woven and knitted fabric, the density of warp and weft yarns at the "regular strength different positions" should be equal. To further avoid the aforementioned appearance, the surface of the "regular strength different positions" can be covered with cut piles, loop piles, or tufts formed from the yarns which have the same dyeing properties, fineness, number of twist, material properties, and the like. When the elastic fabric is formed as a double fabric with a surface stratum formed from face yarns and a back stratum formed from back yarns, lower stretch yarns which have the same material properties, fineness, number of fibers, and degree of twist are preferably used for the surface stratum of the "regular strength different positions".

The elastic yarn having a fineness of more than 300 dtex is bar shaped and has a flat, slippery surface. Therefore, the surface of the elastic fabric is also flat and slippery. And, when limbs are rested upon an elastic cover material formed from such elastic fabric, the limbs cannot be maintained in a comfortable posture, and fatigue occurs.

In accordance with the present invention, the average coefficient of friction (ω) of the surface of the elastic fabric is increased above 0.26 ($0.26 \leqq \omega$) by using a non-slip yarn, which has fine fibers with a single fiber fineness less than 30 dtex, to form the elastic fabric, and by floating the fine fibers over the surface of the elastic fabric so that the non-slip yarn exposes at least an area of 1 $cm^2$ (lengthwise 1 cm×crosswise 1 cm). The average coefficient of friction (ω) of the surface of the elastic fabric is calculated through following steps.

(Step i)

A rectangular test fabric is cut out from the elastic fabric, the test fabric having dimensions of 20 cm×20 cm, and is spread over and fixed on the surface of a metal plate which has a mirror finish and is supported horizontally.

(Step ii)

A stainless steel rectangular contact segment having dimensions of 10 mm×10 mm and 20 channels of width 0.1 mm and depth 0.1 mm across the undersurface, is put on the test fabric.

(Step iii)

A load of 50 gf is set on the test fabric through the contact segment.

(Step iv)

The contact segment is moved at a speed of 0.1 mm/second to and fro a distance of 30 mm in a direction perpendicular to the channels.

(Step v)

The coefficient of friction (ω1) in the longitudinal direction of the elastic fabric is calculated by dividing the average value of the frictional force ($F_1$; gf) between the contact segment and the test fabric by the load (50 gf). The coefficient of friction (ω2) in the lateral direction of the elastic fabric is calculated by dividing the average value of the frictional force ($F_2$; gf) between the contact segment and the test fabric by the load (50 gf). The average coefficient of friction (ω) of the surface of the elastic fabric is calculated as the average ($0.5\omega\mathbf{1}+0.5\omega\mathbf{2}$) of the coefficient of friction (ω1) in the longitudinal direction and the coefficient of friction (ω2) in the lateral direction.

A reason to make the fine fibers float or to expose the non-slip yarn among the rectangular area of 1 $cm^2$ of the surface of the elastic fabric is that the elastic fabric may be formed similarly to conventional fabric which is made from a fiber of fineness less than 30 dtex.

A reason to set the size of the measuring area of the undersurface of the contact segment at 10 mm×10 mm is that a non-slip effect caused by the non-slip yarn cannot be achieved with a porous fabric for which the space between yarns is more than 10 mm. It is required to distribute the fine fibers of fineness less than 30 dtex uniformly over the whole surface of the elastic fabric to achieve the non-slip effect due to the non-slip yarn.

The present invention intends to minimize the ratio of the exposed area of the thick and slippery elastic yarn through the existence of the fine fibers of fineness less than 30 dtex.

However, it is not necessary to completely cover the surface of the elastic fabric with the fine fibers of fineness less than 30 dtex. Since the surface of the elastic fabric should be somewhat slippery to promote a comfortable and natural feel to the limbs which are not restrained on the surface. In consideration of these matters, an average coefficient of friction (ω) of the surface of the elastic fabric should be less than 0.60 ($0.26 \leqq \omega \leqq 0.60$), preferably within 0.30~0.50 ($0.30 \leqq \omega \leqq 0.50$), further preferably within 0.35~0.40 ($0.35 \leqq \omega \leqq 0.40$). to that end, the ratio of exposed area of the non-slip yarn to the measuring area, lengthwise 10 mm×crosswise 10 mm, may generally be less than 50%, preferably within 5%-30%, further preferably within 15%-25% (generally about 20%).

The following yarns can be used for the non-slip yarn.

(i) spun yarn and napped multifilament yarn having float tufts, (ii) ring yarn having a ring like bumpy surface formed by annex yarns surrounding a core yarn, (iii) slub yarn having a slub like bumpy surface formed by annex yarns surrounding a core yarn, (iv) fuzzy ball yarn having a fuzzy ball-like bumpy surface formed by annex yarns climbing up a core yarn, (v) sheath core conjugate yarn having a bumpy surface formed by covering core yarn by sheath yarn, (vi) interlaced yarn having a bumpy surface formed by over feeding multifilament, (vii) chenille yarn formed by fixing decorative yarn to a core yarn, (viii) flocked yarn formed by electrostatically fixing fiber fragments to a core yarn, (ix) cord yarn having a napped surface formed by cutting natural leather, synthetic leather, artificial leather, non-woven fabric and the like.

The elastic fabric may be finished by raising its surface to create a nap on the surface where the non-slip yarn is exposed. When conventional spun yarn and multifilament yarn are used for the non-slip yarn, the surface of the elastic fabric may be covered with piles formed by these conventional yarns. In this connection, it is desirable to use chenille yarns and flocked yarns as the non-slip yarn, since the surface of these yarns are covered with piles.

In the case where the elastic fabric is formed as a double fabric with a surface stratum formed from face yarns and a back stratum formed from back yarns, it is desirable to apply the elastic yarn to the back fabric (34) and apply the non-slip yarn to the face fabric (32).

Embodiment [C-1]

A polyester spun yarn (fineness: 2 ply/meter count of 10 in single yarn) is used in the warp direction with a warp density of 64/10 cm.

The above-mentioned thermo adhesible sheath core conjugate elastic polyether-ester yarn "Dia-Flora" used in the Embodiment [A-1] is used for the first weft yarn.

A chenille yarn (fineness: meter count of 1/2.8) is used for the second weft yarn. The chenille yarn comprises a decorative pile yarn for which a multifilament texturized yarn (fineness: 167 dtex) is used, and a core yarn for which a polyester spun yarn (fineness: cotton count of 20, single fiber 1.4 dtex) and a thermo adhesible nylon monofilament yarn (fineness: 78 dtex) are used.

The fabric is woven using a twill weave by inserting reciprocally the first weft yarn and the second weft yarn at every pick with a weft density of 120/10 cm.

The woven fabric is finished as an elastic woven fabric (10) by passing it through a dry-heating treatment at 190° C. for 3 minutes and by thermally adhering the warp yarns and the weft yarns.

Stress at 10% elongation (F) in the width direction (r) of the elastic woven fabric (10) is 217 (N/5 cm).

Coefficient of friction (ωh) in the weaving length direction of the elastic woven fabric (10) is 0.375.

Coefficient of friction (ωr) in the weaving width direction of the elastic woven fabric (10) is 0.387.

Average coefficient of friction (ω) of the surface of the elastic fabric is 0.381.

Embodiment [C-2]

A polyester spun yarn (fineness: 2 ply/meter count of 10 in single yarn) is set in warping with a warp density of 64/10 cm.

The above-mentioned thermo adhesible sheath core conjugate elastic polyether-ester yarn "Dia-Flora" is used for the first weft yarn.

The above-mentioned chenille yarn (fineness: meter count of 1/2.8) is used for the second weft yarn.

A ring yarn (fineness:meter count of 1/3.8) made by applying a polyester multifilament yarn (fineness: 501 dtex (167×3), single fiber fineness: 3.4 dtex) to an annex yarn, by applying a multifilament texturized yarn (fineness: 166 dtex (83×2), single fiber fineness: 3.4 dtex) to a core yarn, and by applying a multifilament texturized yarn (fineness: 83 dtex, single fiber fineness: 3.4 dtex) and a multifilament texturized yarn (fineness: 167 dtex, single fiber fineness: 3.4 dtex) to a binder yarn, is used for the third weft yarn (non-slip yarn).

The fabric is woven in a twill weave by inserting the first weft yarn and the second weft yarn and the third weft yarn in order with density in the weft direction of 136/10 cm.

The woven fabric is finished as an elastic woven fabric (10) by passing it through a dry-heating treatment at 190° C. for 3 minutes and by thermally adhering the warp yarn and the weft yarn.

Stress at 10% elongation (F) in the width direction (r) of the elastic woven fabric (10) is 266 (N/5 cm).

Coefficient of friction (ωh) in the weaving length direction of the elastic woven fabric (10) is 0.398.

Coefficient of friction (ωr) in the weaving width direction of the elastic woven fabric (10) is 0.391.

Average coefficient of friction (ω) of the surface of the elastic fabric is 0.385.

Comparison [C-1]

A polyester spun yarn (fineness: 2 ply/meter count of 10 in single yarn) is in the warp direction with a density of 64/10 cm.

The above-mentioned thermo adhesible sheath core conjugate elastic polyether-ester yarn "Dia-Flora" used in the Embodiment [A-1] is used for the weft yarn.

The fabric is woven in a twill weave with a density in the weft direction of 136/10 cm.

The woven fabric is finished as an elastic woven fabric (10) by passing it through a dry-heating treatment at 190° C. for 3 minutes and by thermally adhering the warp yarns and the weft yarns.

Stress at 10% elongation (F) in the width direction (r) of the elastic woven fabric (10) is 403 (N/5 cm).

Coefficient of friction (ωh) in the weaving length direction of the elastic woven fabric (10) is 0.202.

Coefficient of friction (ωr) in the weaving width direction of the elastic woven fabric (10) is 0.273.

Average coefficient of friction (ω) of the surface of the elastic fabric is 0.238.

In accordance with the present invention, the weight of limbs loaded on the elastic fabric is distributed in all directions, the fabric deforms to accommodate the shape of the limbs, the fabric does not feel sticky, undulatory puckers or crimps do not appear over the surface of the elastic fabric. Thus, an elastic fabric which provides a soft feeling and has high load-hysteresis fatigue resistance can be obtained. When the elastic fabric is hung over and fixed on both its edges to frame parts, which are positioned on both sides of a frame, and which are spaced apart from and opposite to one another, an elastic cover material which is small, easy to deal with, light weight, not bulky, and on which limbs may be supported stably can be obtained.

The invention claimed is:

1. An elastic fabric comprising:

an elastic yarn interlaced in one of the warp and weft directions, said elastic yarn having a breaking elongation of greater than 60%, a rate of elastic recovery after 15% elongation of more than 90%, the elastic fabric having a stress at 10% elongation greater than 150 N/5 cm and less than 600 N/5 cm oriented in a direction parallel to said elastic yarn, and a rate of hysteresis loss between about 20% and about 45%, wherein the stress at 10% elongation in a direction oriented 45 degrees to said elastic yarn is between 5% and 20% of the stress at 10% elongation in said direction oriented parallel to said elastic yarn.

2. An elastic fabric according to claim 1, further having a bulk density greater than 17,000 dtex/cm.

3. An elastic fabric according to claim 1, having a covering rate greater than 30%.

4. An elastic fabric according to claim 1, wherein said fabric is woven and has a rate of intersection less than 0.5.

5. An elastic fabric according to claim 4, wherein the product of the rate of intersection and the covering rate is greater than 0.1.

6. An elastic fabric according to claim 1, wherein said fabric is woven and the bulk density of said elastic yarn is between 0.5 and 3.0 times the bulk density of a yarn that is orthogonal to said elastic yarn.

7. An elastic fabric according to claim 1, wherein said fabric is weft knitted using elastic and inelastic yarns, said fabric comprising a plurality of courses and wales, a plurality of said elastic yarns extending across a plurality of wales of at least one course, and the stress in said fabric at 10% elongation in the direction of said wales being greater than 25 N/5 cm.

8. An elastic fabric according to claim 7, wherein said elastic yarns have an average diameter greater than 1.1 times the average diameter of said inelastic yarns.

9. An elastic fabric according to claim 7, further comprising first and second of said inelastic yarns, said first inelastic yarn forming a base fabric, said second inelastic yarn being interknitted using a float stitch to form needle loops over a plurality of said courses, and said second inelastic yarn forming sinker loops extending over a plurality of said wales.

10. An elastic fabric according to claim 1, wherein said elastic fabric is formed as a three-dimensional construction comprising a face fabric formed from face yarns and a back fabric formed from back yarns, said back yarns comprising said elastic yarn.

11. An elastic fabric according to claim 10, further comprising connecting yarns connecting said face fabric and said back fabric to one another, said connecting yarns not forming either said face fabric or said back fabric.

12. An elastic fabric according to claim 11, further comprising an interspace stratum having a thickness greater than 0.3 mm formed between said face fabric and said back fabric.

13. An elastic fabric according to claim 11, wherein said back fabric comprises said elastic yarns, and said face fabric comprises a knitted net fabric having openings with an area greater than 1 sq mm.

14. An elastic fabric according to claim 13, further comprising a plurality of chain stitch openings formed by said face yarns, said chain stitch openings extending across a plurality of said wales, said chain stitch openings being arranged adjacent to one another and sharing a common face yarn forming said chain stitch openings.

15. An elastic fabric according to claim 14, wherein said back fabric comprises a chain stitch extending lengthwise along the knitting direction of said fabric and an inserted back yarn connecting said chain stitch to said chain stitch openings.

16. An elastic fabric according to claim 11, wherein said connecting yarn comprises an elastic yarn.

17. An elastic fabric according to claim 1, wherein said elastic yarn is thermally adhered to other yarns comprising said fabric.

18. An elastic fabric according to claim 1, wherein said yarns comprising said fabric have tensile preloads oriented both lengthwise and widthwise of said fabric, said tensile preloads being different from one another over different parts of said fabric.

19. An elastic fabric according to claim 1, further comprising first and second yarns interlaced within said fabric, said first and second yarns being oriented orthogonal to one another and having different tensile strengths from one another.

20. An elastic fabric according to claim 19, wherein one of said yarns comprises a low stretch yarn and the other comprises a high stretch yarn, said yarns being interlaced within said fabric in a balanced design throughout said fabric with respect to fabric pattern and density of yarns.

21. An elastic fabric according to claim 1, further comprising the surface of said fabric having a construction thereon selected from the group consisting of cut piles, loop piles and tufts formed from yarns having the same characteristics of dying properties, fineness, degree of twist and material properties.

22. An elastic fabric according to claim 1, having an average coefficient of friction greater than 0.26 achieved by incorporating non-slip yarns over the surface of said fabric, said non-slip yarns having a fineness less than 30 dtex, one of said non-slip yarns being exposed to float over the surface at least every square cm.

23. An elastic fabric according to claim 22, wherein said non-slip yarns form a nap on the surface of said fabric.

24. An elastic fabric according to claim 22, wherein said non-slip yarns form piles on the surface of said fabric.

25. An elastic fabric according to claim 22, wherein said non-slip yarns comprise cord yarn having fineness less than 30 dtex and a napped surface, said cord yarn being formed from material selected from the group consisting of natural leather, synthetic leather, artificial leather, and non-woven fabric.

26. An elastic fabric according to claim 22, wherein said non-slip yarns comprise yarns selected from the group consisting of spun yarn, napped multifilament yarn having float tufts, ring yarn having a ring-like bumpy surface formed by secondary yarns surrounding a core yarn, slub yarn having a slub-like bumpy surface formed by secondary yarns surrounding a core yarn, knap yarn having a knap-like bumpy surface formed by secondary yarns surrounding a core yarn, sheathed core yarns having a bumpy surface formed by secondary yarns surrounding a core yarn, and interlaced yarn comprising multifilaments, said interlace yarns having a bumpy surface formed by overfeeding said multifilaments.

27. An elastic fabric according to claim 22, wherein said non-slip yarns comprise chenille yarns formed by fixing decorative yarn to a core yarn.

28. An elastic fabric according to claim 22, wherein said non-slip yarns comprise flocked yarn formed by electrostatically fixing fiber fragments to a core yarn.

29. An elastic fabric according to claim 1, formed on a frame having two parts positioned in spaced relation to one another, said fabric being hung between said frame parts by fixing opposite edges of said fabric to each of said frame parts.

* * * * *